US008000483B2

(12) United States Patent
de Haan et al.

(10) Patent No.: US 8,000,483 B2
(45) Date of Patent: Aug. 16, 2011

(54) ELECTROSTATIC LOUDSPEAKER SYSTEMS AND METHODS

(75) Inventors: Hidde de Haan, Jomtien (TH); James Tuomy, Framingham, MA (US); Ronald Buining, Zeist (NL); Gaston Bastiaens, Westerlo (BE); Ton Hoogstraaten, SE Maarheeze (NL)

(73) Assignee: Transparent Sound Technology B.V. (NL)

( * ) Notice: Subject to any disclaimer, the term of this patent is extended or adjusted under 35 U.S.C. 154(b) by 1264 days.

(21) Appl. No.: 11/618,333

(22) Filed: Dec. 29, 2006

(65) Prior Publication Data

US 2007/0189559 A1 Aug. 16, 2007

Related U.S. Application Data

(60) Provisional application No. 60/755,928, filed on Jan. 3, 2006, provisional application No. 60/811,951, filed on Jun. 8, 2006.

(51) Int. Cl.
*H04R 3/00* (2006.01)
*H04R 25/00* (2006.01)

(52) U.S. Cl. ..... 381/190; 381/191; 381/116

(58) Field of Classification Search ..... 381/306, 381/333, 113, 116, 190, 191, 174, 388, 152; 367/170, 181; 181/167, 168
See application file for complete search history.

(56) References Cited

U.S. PATENT DOCUMENTS

| | | | | |
|---|---|---|---|---|
| 3,668,336 | A | 6/1972 | Wright | 179/111 R |
| 3,894,333 | A * | 7/1975 | Chang | 29/594 |
| 6,188,772 | B1 * | 2/2001 | Norris et al. | 381/191 |
| 6,201,874 | B1 * | 3/2001 | Croft et al. | 381/191 |
| 6,304,662 | B1 * | 10/2001 | Norris et al. | 381/191 |
| 6,393,129 | B1 * | 5/2002 | Conrad et al. | 381/191 |
| 6,459,799 | B1 | 10/2002 | Smits | 381/191 |
| 2005/0147265 | A1 * | 7/2005 | Smits et al. | 381/191 |

FOREIGN PATENT DOCUMENTS

WO WO 00/01195 1/2000

OTHER PUBLICATIONS

Valin, J., *The Sound Lab Millennium-1 Electrostatic Loudspeaker, the absolute sound®*, Issue 122, Feb./Mar. 2000.
*The LFT-VIII Planar Magnetic Hybrid Loudspeaker*, accessed at www.eminent-tech.com/lft8prod.html on May 10, 2006.
Harris, T., *Alternative Speaker Designs*, pp. 13-15 of document entitled *How Speakers Work*. Accessed at http://electronics.howstuffworks.com/speaker.htm/printable on May 10, 2006.
MartinLogan Ltd., *Electrostatic Loudspeakers 101: Why Bother?* Accessed at http://www.us.martinlogan.com/technology/electrostatic_theory.html on Mar. 2, 2007.
MartinLogan Ltd., *MartinLogan Electrostatic Advancements*, accessed at http://www.us.martinlogan.com/technology/ml_electrostatic_advances.html#xstat on Mar. 2, 2007.
MartinLogan Ltd., *ATF™(Advanced Thim Film) Theory*, accessed at http://www.us.martinlogan.com/technology/atf_theory.html on Mar. 2, 2007.
MartinLogan Ltd., *MartinLogan Bass Technologies*, accessed at http://www.us.martinlogan.com/technology/bass_technology.html#poweredforce on Mar. 2, 2007.
PCT/US2006/49633 International Search Report dated Nov. 6, 2007.

* cited by examiner

*Primary Examiner* — Tuan D Nguyen
(74) *Attorney, Agent, or Firm* — DeMont & Breyer LLC

(57) ABSTRACT

Embodiments of an electrostatic loudspeaker utilize first and second stators and a diaphragm disposed therebetween, each of the stators and the diaphragm having an electrically conductive portion, wherein the conductive portions of the first stators are electrically coupled to each other; the conductive portions of the second stators are electrically coupled to each other; and the conductive portions of the diaphragms are electrically isolated from each other. The first stators and the second stators may be realized by common first and second stators may be mounted obliquely with respect to one another, so as to achieve differentially greater spacing between stators of the first one of the speaker elements than between stators of the second one of the speaker elements. Protective circuitry is also provided.

12 Claims, 37 Drawing Sheets

ELECTROSTATIC LOUDSPEAKER SYSTEMS AND METHODS

RELATED APPLICATIONS

The present application claims priority from U.S. provisional application Ser. No. 60/755,928, filed Jan. 3, 2006, and U.S. provisional application Ser. No. 60/811,951, filed Jun. 8, 2006. These related applications are hereby incorporated herein by reference.

TECHNICAL FIELD

The present invention relates to loudspeaker systems, and more particularly to electrostatic loudspeaker systems and methods.

BACKGROUND ART

Electrostatic loudspeakers and relevant developments are described in the white paper entitled "Final Inverter Technology™ for Electrostatic Speakers available at the website of Final Sound Solutions B.V., an affiliate of the assignee herein, at http://www.finalsound.com/downloads/WP-Inverter0905.pdf. The foregoing document is attached to and a part of U.S. provisional application Ser. No. 60/811,951, filed Jun. 8, 2006. In addition, developments are described in U.S. Pat. No. 7,054,456, for an invention of Maarten Smits and Hidde W. de Haan, entitled "Invertedly driven electrostatic speaker." This patent is also incorporated herein by reference.

SUMMARY OF THE INVENTION

In a first embodiment of the invention there is provided an electrostatic speaker system having a plurality of electrostatic speaker elements. Each electrostatic speaker element includes first and second stators and a diaphragm disposed therebetween. Each of the stators and the diaphragm have an electrically conductive portion. The conductive portions of the first stators are electrically coupled to each other; the conductive portions of the second stators are electrically coupled to each other; and the conductive portions of the diaphragms are electrically isolated from each other.

In a further embodiment, the conductive portion of the diaphragm of a first one of the speaker elements has a surface area that is substantially greater than the surface area of the conductive portion of the diaphragm of a second one of the speaker elements, so that the first and second speaker elements are each suited to handling distinct first and second frequency ranges respectively. The first frequency range is lower than the second frequency range.

In a further embodiment, spacing between the first and second stators of the first one of the speaker elements is greater than spacing between the first and second stators of the second one of the speaker elements. The greater spacing accommodates larger signal amplitudes, while the small spacing in the second one of the speaker elements provides relatively greater sensitivity.

In yet a further embodiment, all the first stators of the speaker elements are regions of a common first stator for all speaker elements, all the second stators of the speaker elements are regions of a common second stator for all speaker elements, and the conductive portions of the diaphragms are regions of a common diaphragm for all speaker elements.

In a further embodiment, pair of conductive portions of the common diaphragm share a non-conductive boundary and at least one spacer is disposed between the common first stator and the common diaphragm and between the common second stator and the common diaphragm, while no spacer coincides with the non-conductive boundary.

Optionally, the common first stator and the common second stator are mounted obliquely with respect to one another, so as to achieve differentially greater spacing between stators of the first one of the speaker elements than between stators of the second one of the speaker elements.

In another related embodiment, the speaker system additionally includes a dc high voltage source having a positive potential, relative to a reference node, electrically coupled to the conductive portions of the first stators and a negative potential, relative to the reference node electrically coupled to the conductive portions of the second stators. The speaker system also includes a separate audio signal path associated with each diaphragm. Each separate audio signal path is electrically coupled to the conductive portion of the associated diaphragm and relative to the reference node. Each separate audio signal path optionally includes a separate step-up transformer, which may have a characteristic selected for a different frequency range. As a further option, there may be comprising a resistor in series with a winding of at least one of the step-up transformers, so that a parasitic capacitance of the electrically conductive portion of the diaphragm associated with the step-up transformer in relation to the corresponding stators, as reflected by the step-up transformer, cooperates with the resistor to form a low-pass filter. As a further option, there may be a resistor in parallel with a winding of at least one of the step-up transformers, so that a parasitic capacitance of the electrically conductive portion of the diaphragm associated with the step-up transformer, in relation to the corresponding stators, as reflected by the step-up transformer, is reduced so as to provide reduced high frequency attenuation. More generally, as an option, one of the separate audio signal paths may include a low-pass filter and the other of the audio signal paths may include a high-pass filter.

Another embodiment of the present invention provides an electrostatic speaker system, and the system includes at least one electrostatic speaker element having a pair of stators and a diaphragm disposed therebetween. Each of the stators and the diaphragm has an electrically conductive portion. In addition, the system includes a dc high voltage source coupled to the at least one speaker element for biasing the diaphragm relative to the stators, an audio signal input for receiving an audio signal and coupled to the at least one speaker element for causing motion of the diaphragm to produce sound, and a dc protection circuit operative to disable the dc high voltage source if an electrical parameter meets a predetermined criterion. In one embodiment, the parameter is current through the high voltage source and the criterion is a threshold value. In another embodiment, the parameter is power provided by the high voltage source and the criterion is a threshold value. In yet another embodiment, the parameter is absence of an audio signal above a detection threshold on the audio signal input and the criterion is duration of such absence for a predetermined period of time. In yet another embodiment, the parameter is level of an audio signal on the audio signal input and the criterion is an overload limit.

Another embodiment of the present invention provides electrostatic speaker system that includes at least one electrostatic speaker element having a pair of stators and a diaphragm disposed therebetween. Each of the stators and the diaphragm has an electrically conductive portion. The system also includes a dc high voltage source coupled to the at least one speaker element for biasing the diaphragm relative to the stators, an audio signal input for receiving an audio signal and coupled to the at least one speaker element for causing motion of the diaphragm to produce sound, and an audio protection circuit operative to disable coupling of the audio signal input to at least one speaker element if level of an audio signal at the audio input exceeds a predetermined limit.

Both the embodiment immediately above, having an audio protection circuit, and the embodiments discussed previously, having and a dc protection circuit, may be optionally implemented with a microprocessor executing instructions causing generation of a signal used to trigger the protection, either to gate the high voltage source or to disable coupling of the audio signal input, as the case may be. Moreover, all such protection features may be implemented together. These embodiments are also applicable to a further embodiment wherein the dc high voltage source has a positive potential, relative to a reference node, coupled to one of the stators and a negative potential, relative to the reference node, coupled to the other of the stators; and the audio signal input is coupled to the diaphragm relative to the reference node.

In another embodiment, the invention provides an electrostatic speaker system. The speaker system includes at least one electrostatic speaker element having first and second stators and a diaphragm disposed therebetween. Each of the stators and the diaphragm having an electrically conductive portion. The diaphragm further includes a highly conductive line, formed thereon by printing, along a border of the diaphragm's electrically conductive portion. In a further related embodiment, the line includes silver.

In another embodiment, the invention provides an electrostatic speaker system that includes at least one electrostatic speaker element having first and second stators and a diaphragm disposed therebetween. Each of the stators has an electrically conductive portion, the diaphragm has two sides and a distinct electrically conductive portion on each side. Moreover, the conductive portion on a first side is coupled to an audio input for receiving an audio signal and the conductive portion on a second side is used to provide a signal representing the position of the diaphragm.

In another embodiment, the invention provides an electrostatic speaker system that includes at least one electrostatic speaker element having first and second stators and a diaphragm disposed therebetween. Each of the stators and the diaphragm has an electrically conductive portion. The electrically conductive portion of the diaphragm is formed by printing on the diaphragm a conductive ink of the type having very finely divided conductive pigment particles in a thermoplastic resin. There is also a protective coating over the conductive portion of the diaphragm. Optionally, the conductive ink is Lumidag EL-016. Also optionally, the protective coating is dry printed PVC film or dry printed acrylic film. As yet another option, the conductive ink employs nano particles of antimony tin oxide or indium tin oxide or of both oxides in an acrylic binder that is both heat and UV curable.

In another embodiment of the present invention, there is provided an electrostatic speaker system. The system includes at least one electrostatic speaker element having first and second stators and a diaphragm disposed therebetween. Each of the stators and the diaphragm has an electrically conductive portion. In this embodiment, each stator, including throughholes therein, is formed on an injection-molded plastic sheet. Optionally, wherein each stator is multi-layered, each layer injection-molded, and one of such layers is conductive. Also optionally, each stator includes a layer over its electrically conductive portion, such layer being powder coated with a double curable powder coat. Alternatively, each stator includes a Parylene coating. Alternatively, each stator includes a coating of double cure black solder mask.

In another embodiment of the present invention, there is provided an electrostatic speaker system. The system includes at least one electrostatic speaker element having first and second stators and a diaphragm disposed therebetween. Each of the stators and the diaphragm has an electrically conductive portion. In this embodiment, the stators have throughholes having a local hole density, and the local hole density of one or both of the stators is varied so as to provide a desired amount of damping of motion of the diaphragm in a region of lower hole density.

In another embodiment, the present invention provides an electrostatic speaker system. The system includes at least one electrostatic speaker element having first and second stators and a diaphragm disposed therebetween. Each of the stators and the diaphragm has an electrically conductive portion. In this embodiment, the system also includes a driver circuit housing disposed near a midpoint of a long dimension of the speaker element and a mount, for mounting the system, coupled to the driver circuit housing.

In another embodiment, the present invention provides an electrostatic speaker system. The system includes at least one electrostatic speaker element having first and second stators and a diaphragm disposed therebetween. Each of the stators and the diaphragm have an electrically conductive portion. In this embodiment, the system also includes first and second sets of peripheral spacers disposed around the periphery of the electrically conductive portion of the diaphragm between the diaphragm and the first and second stators respectively. The system further includes first and second sets of interior spacers disposed along an interior region of the diaphragm between the diaphragm and the first and second stators respectively, wherein the interior spacers have greater compliance than the peripheral spacers.

In a further embodiment, the present invention provides an electrostatic speaker system. The system includes at least one electrostatic speaker element having first and second stators and a diaphragm disposed therebetween. Each of the stators and the diaphragm has an electrically conductive portion. The system also includes first and second sets of spacers disposed between the diaphragm and the first and second stators respectively. Each of the first and second spacers includes a first portion having a first modulus of rigidity and a second portion having a second modulus of rigidity less than the first modulus of rigidity. Optionally, the first and second portions of each spacer are stacked between its corresponding stator and the diaphragm so that the first portion of each spacer is adjacent its corresponding stator and the second portion of each spacer is adjacent the diaphragm. In another embodiment, wherein the first and second portions of each spacer are adjacent each other so that both the first and second portions of each spacer are adjacent the diaphragm. In a further embodiment of the previous embodiments, each spacer further comprises a third portion having a modulus of rigidity between the first and the second modulus of rigidity.

In another embodiment of the present invention, there is provided an electrostatic speaker system. The system includes at least one electrostatic speaker element having first and second stators and a diaphragm disposed therebetween. Each of the stators and the diaphragm has an electrically conductive portion. In this embodiment, the system further includes first and second sets of spacers disposed between the diaphragm and the first and second stators respectively. Each of the first and second spacers has opposed first and second surfaces and a modulus of rigidity that varies continuously from the first surface to the second surface.

In another embodiment, the present invention provides an electrostatic speaker system. The system includes at least one electrostatic speaker element having first and second stators and a diaphragm disposed therebetween. Each of the stators and the diaphragm has an electrically conductive portion, and the diaphragm defines a plane. The system of this embodiment further includes first and second sets of spacers disposed between the diaphragm and the first and second stators respectively. A pair of the first spacers is disposed opposite one another on either side of a longitudinal plane transverse to the plane of the diaphragm. Additionally, a pair of the second spacers is disposed opposite one another on either side of the same longitudinal plane. Finally, in each pair of opposed spacers, such spacers are disposed obliquely with respect to one another.

In another embodiment of the present invention, there is provided an electrostatic speaker system. The system includes at least one electrostatic speaker element having first and second stators and a diaphragm disposed therebetween. Each of the stators and the diaphragm has an electrically conductive portion, and the diaphragm defines a plane. In this embodiment, first and second sets of spacers are disposed between the diaphragm and the first and second stators respectively, and at least one spacer in each of the first and second sets of spacers is non-linear.

In another embodiment of the present invention, there is provided an electrostatic speaker system. The system includes a plurality of stacked electrostatic speaker elements. Each speaker element has first and second stators and a diaphragm disposed therebetween. Each of the stators and the diaphragm has an electrically conductive portion, and each stator is optionally formed of die cast plastic. The system also includes a dc high voltage source having a positive potential, relative to a reference node, coupled to the first stators and a negative potential, relative to the reference node, coupled to the second stators; and each diaphragm is coupled to an audio signal input relative to the reference node. In a further related embodiment, each speaker element includes first and second sets of spacers between the diaphragm and the first and second stators respectively, and the sets of spacers are arranged so as to occur in different relative locations in adjacent elements in the stack.

In yet another embodiment of the present invention, there is provided an electrostatic speaker system. The system includes an electrostatic speaker element having first and second stators and a diaphragm disposed therebetween. Each of the stators and the diaphragm has an electrically conductive portion, and such element has a front and rear from which sound is emanated. The system further includes an amplifier coupled to the at least one speaker element. The amplifier includes a compensating network for reducing artifacts of sound reproduction by the at least one speaker element, such artifacts including phase cancellation effects caused by wall reflection of sound emanated from the rear of the speaker element.

In another embodiment, the invention provides an electrostatic speaker system. The system includes a pair of electrostatic speakers. Each speaker has first and second stators and a diaphragm disposed therebetween. Each of the stators and the diaphragm has an electrically conductive portion. Each speaker has a substantial longitudinal dimension so as to operate as a dipole line array sound source. The system further includes a pair of amplifiers. Each amplifier is coupled to a separate one of the speakers and includes a compensating network so as to provide a Head Related Transfer Function, so that the pair of speakers provides surround sound of superior quality. In a further embodiment, each speaker has a plurality of elements, each element having first and second stators and a diaphragm disposed therebetween, the stators and the diaphragm having conductive portions. The conductive portions of the first stators are coupled to each other, conductive portions of the second stators are coupled to each other and conductive portions of the diaphragms are electrically isolated from each other. The conductive portion of the diaphragm of a first one of the speaker elements has a surface area that is substantially greater than the surface area of conductive portion of the diaphragm of a second one of the speaker elements, so that the first and second speaker elements are each suited to handling distinct first and second frequency ranges respectively, the first frequency range being lower than the second frequency range.

In another embodiment, the invention provides an electrostatic speaker system. The system includes an electrostatic speaker element having first and second stators and a diaphragm disposed therebetween. Each of the stators and the diaphragm has an electrically conductive portion. The system further includes a class D modulator having an output coupled to the electrostatic speaker element through a resistance, so that parasitic capacitance of the speaker element in combination with the resistance provides low pass filtering of the modulator's output. In an alternative embodiment, a class D modulator has an output coupled to the electrostatic speaker element, and the system includes a diaphragm position detector coupled to the diaphragm for providing an output signal indicative of diaphragm position, and the output signal is coupled to the modulator. Optionally, the system includes a digital signal processor coupled to the modulator, and the output signal from the diaphragm position detector is coupled to the digital signal processor. Also optionally, the speaker element is one of a plurality of elements, and each element covers a different frequency range. The digital signal processor provides band pass filtering appropriate to the frequency range of the speaker element. Also optionally, the speaker element has a front and rear from which sound is emanated and the digital signal processor reduces artifacts of sound reproduction by the speaker element, such artifacts including phase cancellation effects caused by wall reflection of sound emanated from the rear of the speaker element. As a further related embodiment, there may be provided a high-pass filter placed between the diaphragm position detector and the diaphragm. Also as a further related embodiment, there may be provided an oscillator, operating at a frequency above the audible range, coupled to the diaphragm, to generate a signal that is modulated by change in internal capacitance of the speaker element. As yet a further embodiment, the diaphragm may have two sides and a distinct electrically conductive portion on each side, the conductive portion on a first side being coupled to the output of the class D modulator to receive an audio signal and the conductive portion on a second side being coupled to the oscillator and the diaphragm position detector.

In another embodiment, the invention provides an electrostatic speaker system. The system includes an electrostatic speaker element having first and second stators and a diaphragm disposed therebetween. Each of the stators and the diaphragm has an electrically conductive portion. The system further includes a class D modulator, the modulator operative at a modulation frequency, having an output coupled to the electrostatic speaker element through a transformer operative at the modulation frequency, so that the transformer need not satisfy specifications for audio frequency transformers.

BRIEF DESCRIPTION OF THE DRAWINGS

FIG. 2 is a front view of an electrostatic speaker according to the embodiment of FIG. 1. FIG. 3 shows a front view of a left and a right electrostatic loudspeaker pair, of which dimensions of the right loudspeaker are provided in FIG. 2. FIG. 4 shows a horizontal cross section of the right loudspeaker of FIG. 2, in a manner generally analogous to FIG. 1. FIG. 5 provides detail at each place marked A, B, C, D, and E of FIG. 4. FIG. 6 is a front view of a diaphragm for a left electrostatic speaker, the diaphragms of which exhibit mirror symmetry in relation to those of the right electrostatic speaker.

DETAILED DESCRIPTION OF SPECIFIC EMBODIMENTS

The contents of U.S. Provisional Patent Application Ser. No. 60/811,951, filed Jun. 8, 2006, and entitled "Electrostatic Speaker Systems and Methods," (referred to below as the "Provisional Application," are hereby incorporated herein by reference.

The present application describes, among other things, improvements to electrostatic loudspeaker systems of the type described in the foregoing documents.

Diaphragm and Stator Geometry

Figure 1:
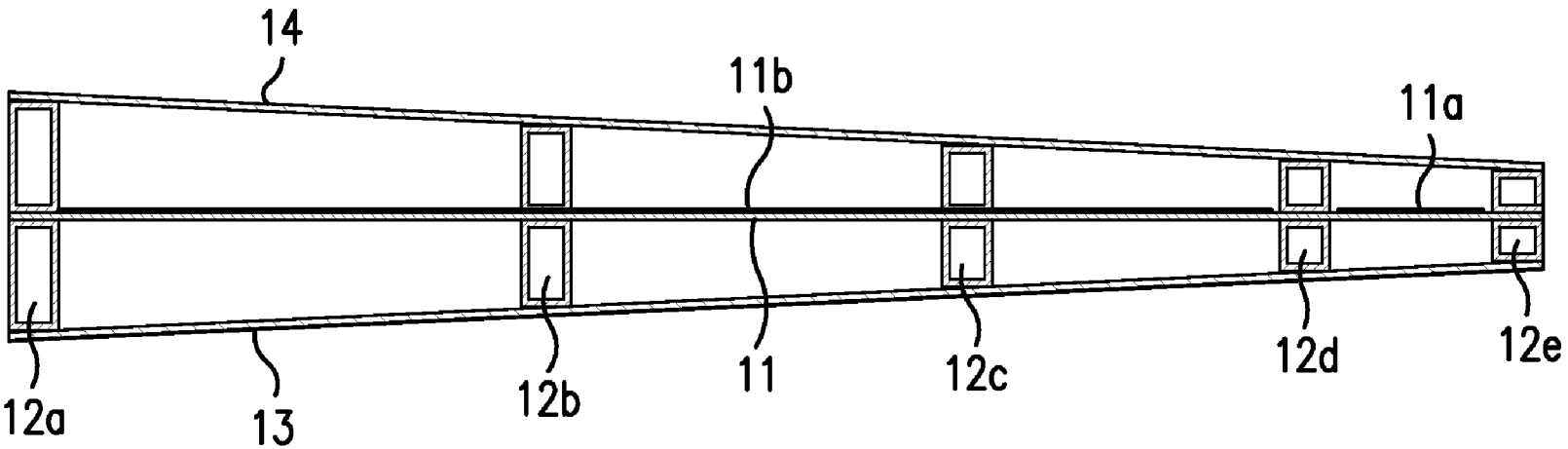
FIG. 1 shows an exaggerated cross section of an embodiment of the present invention providing an electrostatic speaker having two distinct sections for separate reproduction of high frequency sound and of lower frequency sound.

In FIG. 1, there is shown in an exaggerated fashion a cross section of an embodiment of the present invention providing an electrostatic speaker having two distinct sections for separate reproduction of high frequency sound and of lower frequency sound. A diaphragm 11 is mounted between a front stator 13 and a rear stator 14. (We use the term "stator" to refer to the fixed stators, and the term "diaphragm" to refer to the movable element placed between the stators.) The stators are mounted in spaced-apart relation by spacers at 12*a*, 12*b*, 12*c*, 12*d*, and 12*e*. It can be seen from the figure that the space between the stators (and also the stator-to-diaphragm spacing) is greater at the left end of the figure with supports 12*a* and 12*b* than at the right end with supports 12*d* and 12*e*. (The difference in spacing is exaggerated for illustrative purposes.) The diaphragm is divided into two or more distinct electrically conductive regions, a first region 11*a* (between supports 12*d* and 12*e*) and a second region 11*b* (between supports 12*d* and 12*a*). Each region 11*a* and 11*b* is electrically insulated from the other. (Optionally, each region may also be physically constrained so that movement of one region does not affect movement of the other region, or the diaphragm 11 can be divided into physically separate portions.) The first region is driven with an audio signal subjected to a high-pass filter to attenuate lower frequency components and the second region is driven with an audio signal subjected to a low-pass filter to attenuate higher frequency components.

This geometry enables, among other things, use of a large diaphragm-stator arrangement for handling both high frequencies and lower frequencies. Normally, a large diaphragm is inconsistent with reproduction of high frequencies because the resulting radiation pattern is narrowly focused, whereas a large diaphragm is important to achieving significant sound radiation at lower frequencies. Here the large diaphragm can be used for both high and lower frequencies, because it is effectively partitioned into distinct sections for the high and lower frequency bands. Accordingly, the high frequency region of the diaphragm can be constructed as a narrow band running the length of the loudspeaker assembly; the narrow band provides a substantially wider angle of dispersion of high frequencies than would be the case if the entire diaphragm were carrying the high frequency components. Because acoustic reproduction of typical audio signals requires, for a given level of radiation, relatively less travel of the diaphragm for high frequency components than for low frequency components, the stator geometry shown provides a smaller stator-to-diaphragm distance for the first region, which handles the high frequency sound, than for the second region, which handles the lower frequency sound. Moreover, tighter cross-sectional geometry, discussed above, in the first section enables using lower audio signal power for handling the high frequency sound in that section.

Figure 2:
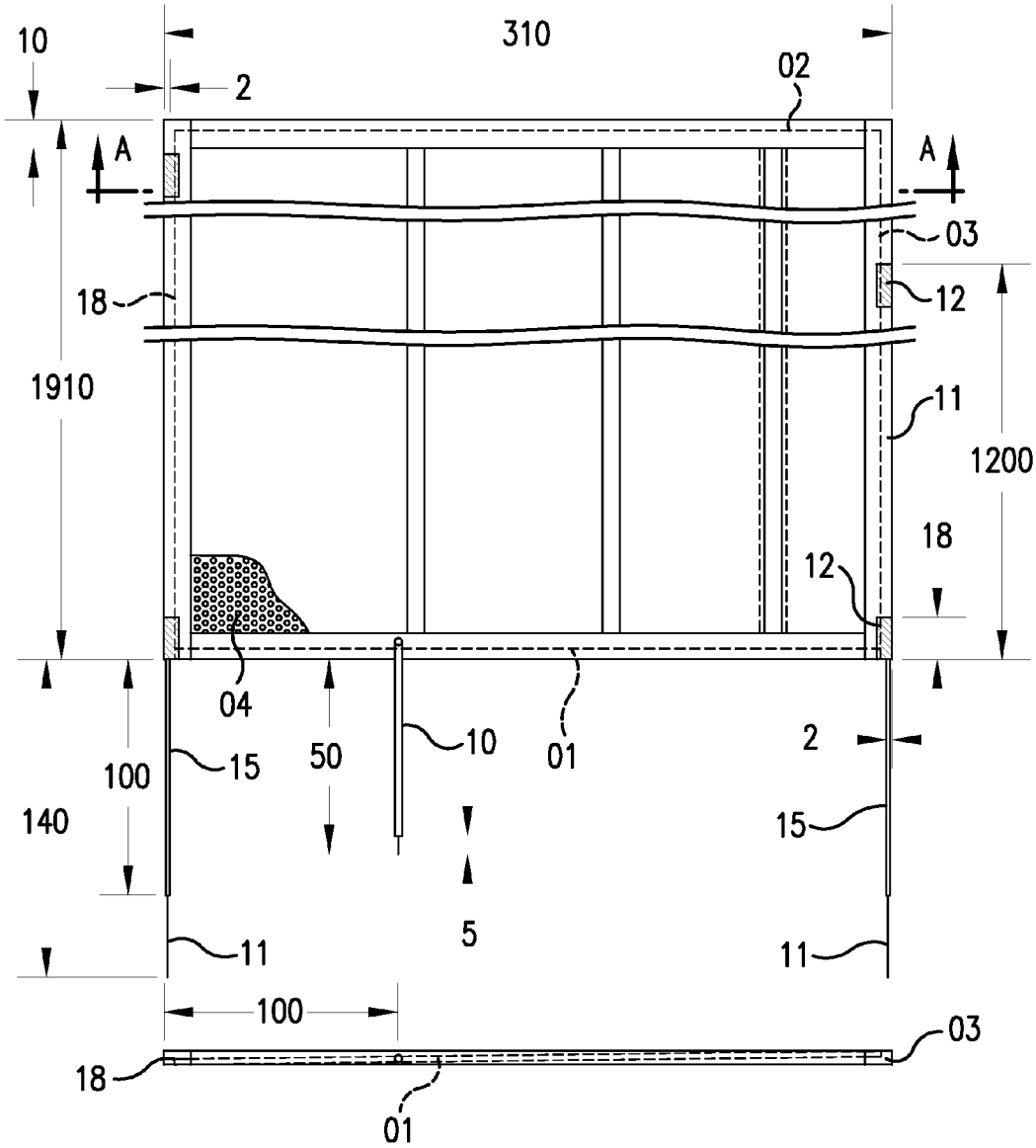
FIGS. 2 through 6 show dimensions for components of an electrostatic loudspeaker made in accordance with the principles discussed in connection with FIG. 1.
Figure 3:
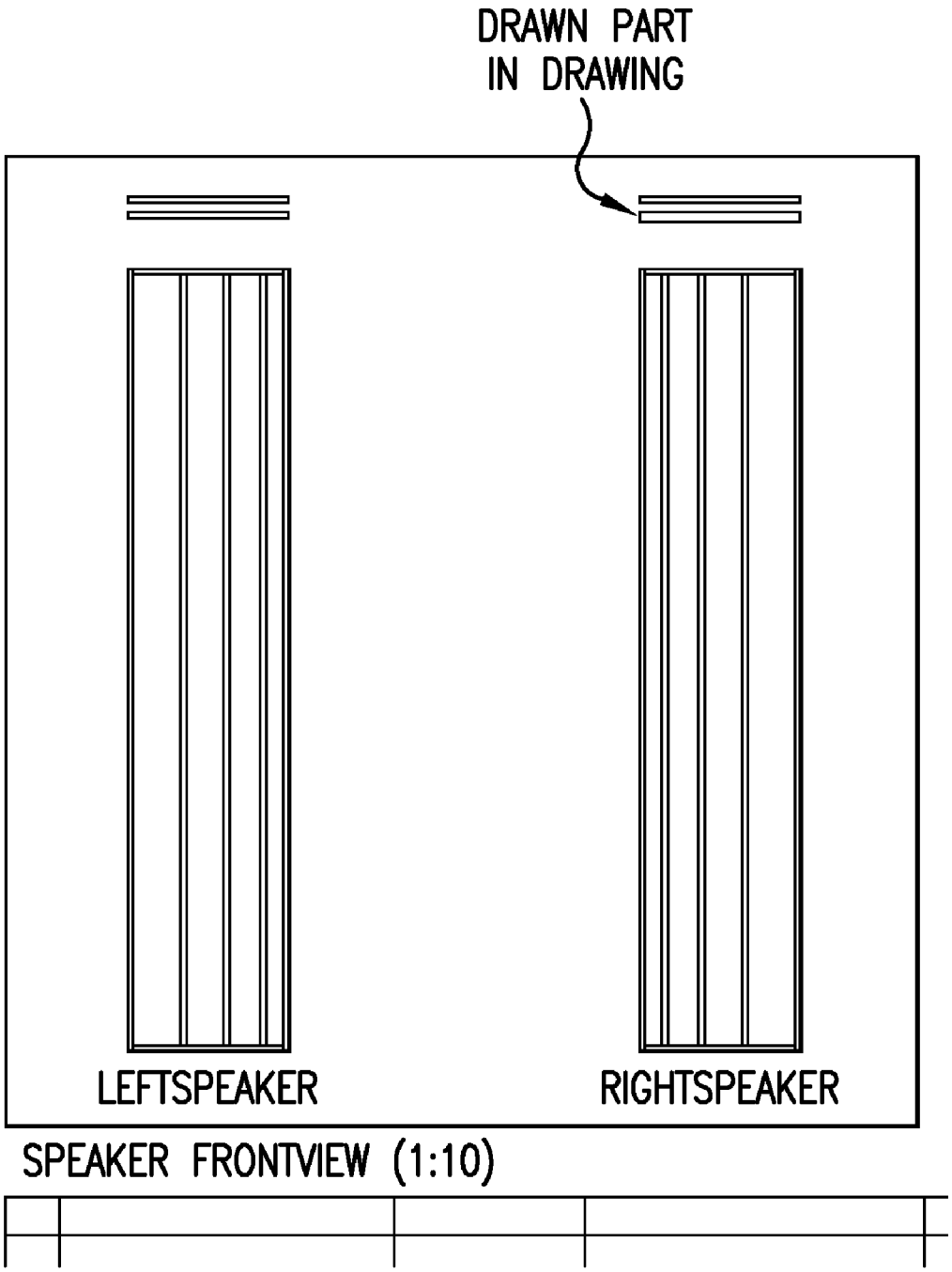
Figure 4:
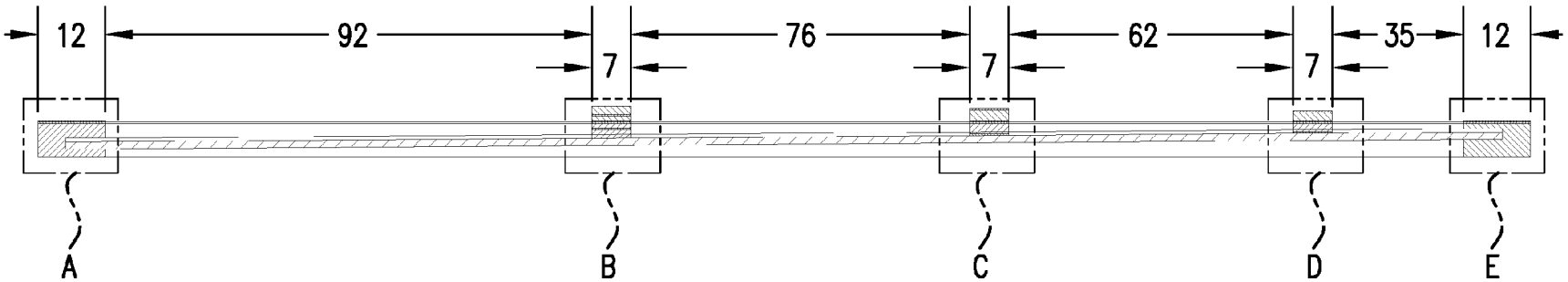
Figure 5:
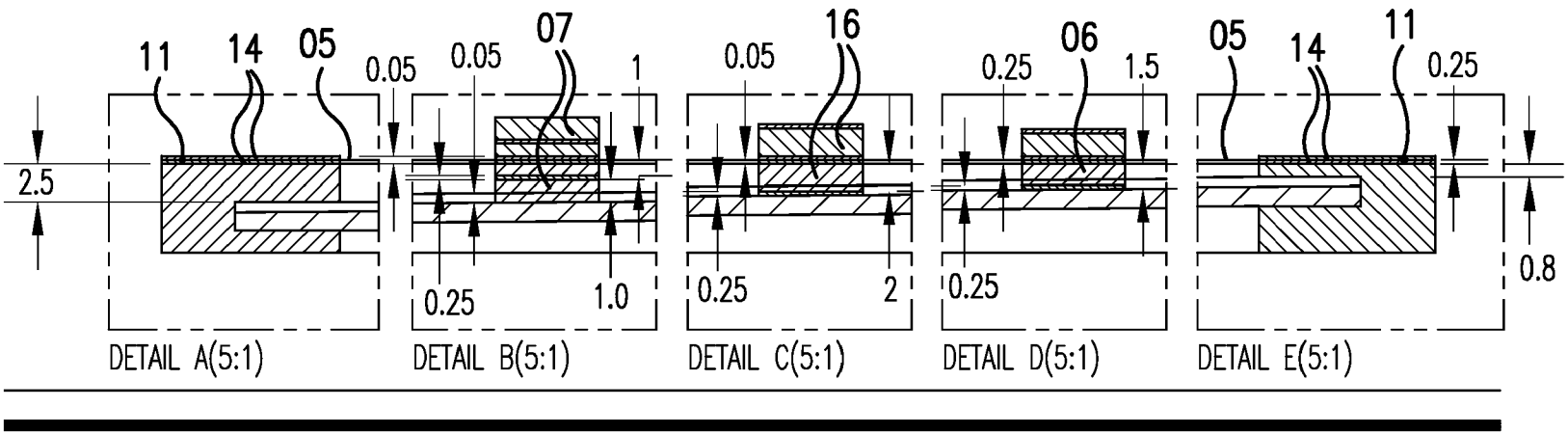
Figure 6:
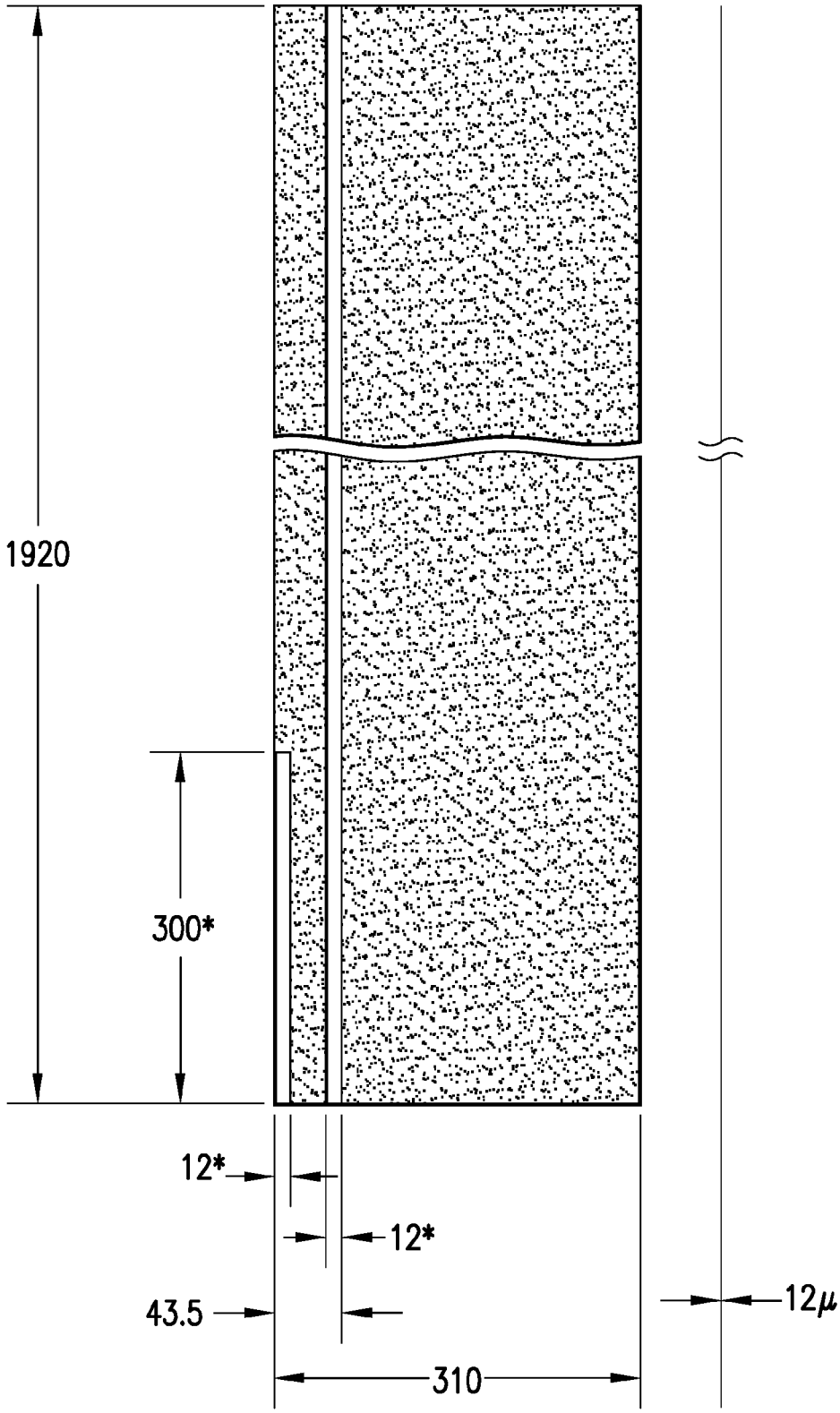

FIGS. 2 through 6 show dimensions for components of an electrostatic loudspeaker made in accordance with the principles discussed in connection with FIG. 1. FIG. 3 shows a front view of a left and a right electrostatic loudspeaker pair, of which dimensions of the right loudspeaker are provided in FIG. 2. FIG. 4 shows a horizontal cross section of the right loudspeaker of FIG. 2, in a manner generally analogous to FIG. 1. FIG. 5 provides detail at each place marked A, B, C, D, and E of FIG. 4. FIG. 6 is a front view of a stator for a left electrostatic speaker, the stators of which exhibit mirror symmetry in relation to those of the right electrostatic speaker.

In these figures, a spacer (item 12*d* of FIG. 1, item D in FIG. 4) is mounted to coincide with the non-conductive part of the diaphragm lying between the two conductive regions of the diaphragm. However, it is not always necessary or desirable to have a spacer coincide with the boundary between two conductive regions of the diaphragm. In accordance with another embodiment of the invention, the diaphragm includes at least two distinct conductive regions separated by a non-conductive boundary, and each conductive region handles a different frequency range. For example, a narrow conductive band of the diaphragm, like that of FIG. 1, can run the whole length of the diaphragm for handling high frequencies. The diaphragm of this embodiment is mounted, between the stators, without a spacer coinciding with the non-conductive boundary. In other words, the spacer 12*d* of FIG. 1 is absent in this embodiment. With such a design, therefore, the high frequency section of the diaphragm occupies only a portion of the span between mounting locations in which it is included (corresponding to mounting locations 12*c* and 12*e* of FIG. 1), and still high frequency sound energy is confined to the high frequency section of the diaphragm, even though the bulk of the span receives energy from middle and low frequency components.

Except where the context requires otherwise, the distances in FIGS. 2 through 6 are in mm. Thus, a reading of the figures shows that the loudspeakers have a vertical dimension of the order of 2000 mm, or 2 meters. They are large loudspeakers, yet, for the reasons discussed previously, their design permits them to render both high frequencies and lower frequencies.

The legend for FIGS. 2 through 6 is as described in Table 1, below.

TABLE 1

| No. | Name | Material | Dimensions |
|---|---|---|---|
| 01 | Profile (sides top/bottom) | Forex 6 mm | |
| 02 | Profile (sides top/bottom) | Forex 6 mm | |
| 03 | Profile (sides long) | Forex 6 mm | |
| 04 | Statorpanel (stator) | Steel ST 13 | |
| 05 | Diaphragm | Mylar Type A | |
| 06 | Spacer small | PVC 1.5 mm | |
| 07 | Spacer large | PVC 2 mm | |
| 08 | | | |
| 09 | | | |
| 10 | Cable stator | Pink | |
| 11 | Silver wire | Silver | d = 0.2 mm; total: L = 2980 mm |
| 12 | Tape | | 18 × 7 × 0.03 mm |
| 13 | | | |
| 14 | Tape | 3MVHB 9473 | 0.25 × 12 mm total; L = 3592 T |
| 15 | Tube (shrinkable) | Polyolefine | 02.5; L = 100 mm |
| 16 | Spacer medium | PVC 1.5 mm | |
| 17 | | | |
| 18 | Profile (sides long) | Forex 6 mm | |

Although the above embodiment provides a loudspeaker having two sections, each for a different frequency range, it is within the scope of the present invention to provide an electrostatic loudspeaker having more than two sections, each for a different frequency range, with each section fed by a separate band-pass filter. The use of three or more sections provides further advantages, albeit at a cost of greater complexity, including the need for more band-pass filters, for example.

The different sections may be oriented adjacent to each other and in any order. In one embodiment, however, the different sections are arranged in order of increasing frequency bands for which the sections are adapted, so as to provide a mirror like arrangement in the case of two loudspeakers for generating a stereo sound field. A further benefit of such arrangement lies in the prospect of employing progressively small stator-to-diaphragm spacing with sections having progressively higher frequency bands, in the manner previously discussed. Other arrangements are not excluded, like arranging the different sections in a clockwise or anti-clockwise fashion in a plane.

Diaphragm and Stator Materials

Figure 7:
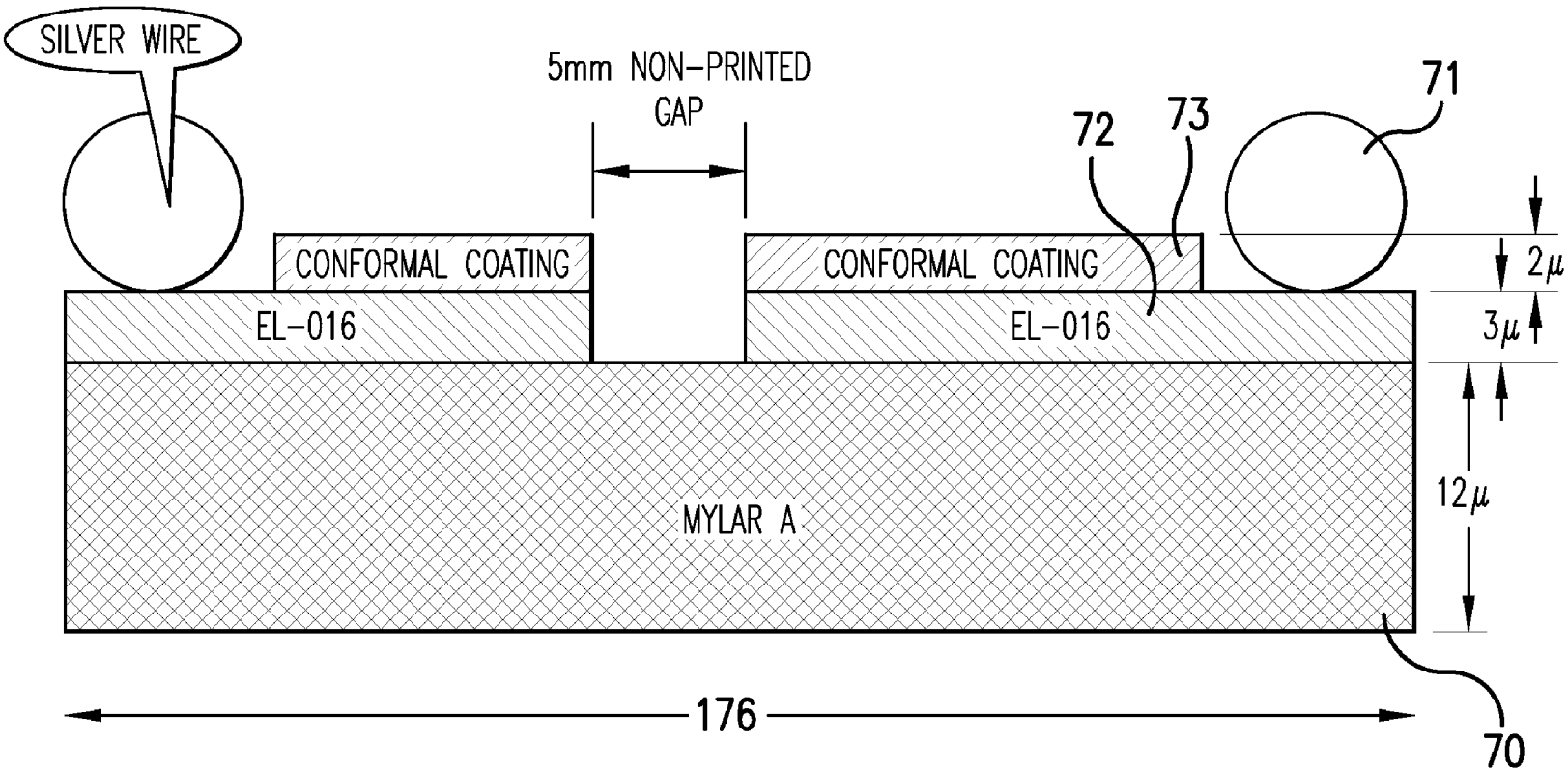
FIG. 7 is an exaggerated cross section of an embodiment of a diaphragm in accordance with the present invention.

FIG. 7 is an exaggerated cross section of an embodiment of a diaphragm in accordance with the present invention. The base material 70 is a Mylar® biaxially-oriented polyethylene terephthalate (BOPET) polyester film, available from DuPont Teijin Films (Hopewell, Va., at (800) 635-4639) of 4-12μ in thickness. However other brands (e.g. Toray) and types of insulating substrates, such as polyphenylene sulfide (PPS), are also possible. We have found that a conductive layer 72 on the film can be established using printing techniques, where the ink is Acheson (available from Acheson Industries, Port Huron Mich., and Scheemda, Netherlands) Lumidag EL-016 mixed with filling compound 85/15. Lumidag EL-016 is an ink having very finely divided translucent conductive pigment particles in a thermoplastic resin. A dry printed film of about 3-4μ is applied, and the film is dried at a temperature of about 105° C. Again, it is also possible to use other conductive materials, such as an ink employing nano particles of antimony tin oxide (ATO), in an acrylic binder, to produce a layer approximately 2 microns thick; the binder can be both heat and UV curable. In operation, first such a binder is heat cured, then UV cured, so that curing of the binder may be achieved, for example, at a temperature as low as 80° C. Use of a material that is double curable in this environment enables use of a high speed printing at relatively low temperature.

Thereafter, a protective coating 73 is applied. This coating electrically insulates the conductive coating and protects against moisture and micro-sparks. The coating can be applied as a dry printed PVC or acrylic film about 1.5 or 2μ thick. The coating is dried at a temperature of less than about 105° C. Alternatively a double curable acrylic ink can be printed at 80° C. A conductive lead is attached to the diaphragm, such that the lead is in electrical contact with the conductive layer. For example, a silver wire 71 can be pressed against the conductive layer.

Figure 8:
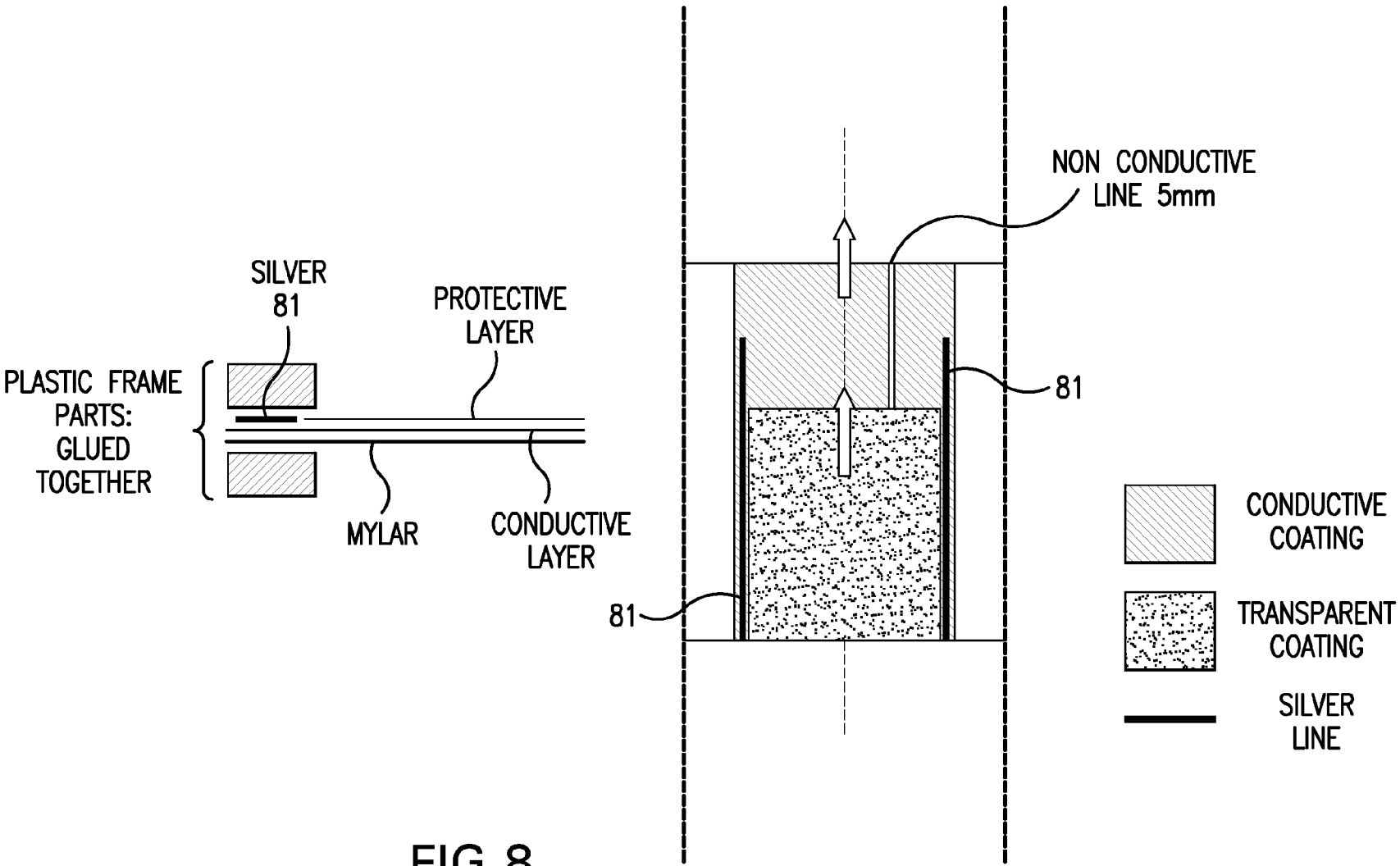
FIG. 8 illustrates another embodiment of a diaphragm in accordance with the present invention, and provides a cross section as well as a front view.

Alternatively, as illustrated in FIG. 8, in accordance with another embodiment of the present invention, in lieu of the silver wire, there may be employed a highly conductive printed ink line 81 of silver or silver-carbon composition, such as type PF410 for low speed screen printing or PM460A for high speed flexo printing, both available from Acheson Industries (Port Huron, Mich. and Scheemda, the Netherlands). FIG. 8 shows on the left a cross sectional view of the diaphragm and on the right a top view looking down on a printing press in which the diaphragm is being coated. The ink line 81 is applied over the conductive layer 72 of FIG. 7, along the edges of the diaphragm and is used to make good electrical connection to the conductive layer 72. Here the silver ink line may be applied as part of a standard rotating screen printing process. For the low speed alternative, a printing speed of 4 m/min. and a temperature of 105° C. are typical conditions, whereas for high speed printing, 15 m/min. and a temperature of 80° C. are typical.

The above arrangement provides a single layer of conductive material applied on an insulating carrier. It is also possible, in accordance with another embodiment of the present invention, to apply a conductive layer on both sides of the carrier 70. The conductive layers can then be electrically mutually connected to the signal source so as to obtain more geometric symmetry in the speaker system. It is however also possible to use only one of the conductive layers as the active driving layer, whereas the second layer may be used for control purposes. One of these control purposes may be for providing a signal representing the position of the diaphragm.

In combination with the separation of the loudspeaker into several sections for different frequency ranges, the conductive layer, either on one or on both sides of the insulating substrate of the diaphragm, may be separated in different electrical sections to provide the required electrical separation (isolation) of the diaphragm into the relevant sections. Consequently it may be possible to cover only that part of the insulating substrate on both sides which forms the high frequency section, as due to the smaller distance between the stators and the diaphragm, the symmetry is of more importance.

The stators (stator panels) described in Table 1 are made of perforated steel. The stators can be coated with any suitable material to provide electrical isolation, to protect them from oxidizing and/or to provide a loudspeaker having a desired color. For example, a spray paint or (preferably) a powder coating (such as RILSAN® polyamide from Atotech (Berlin, Germany) is applied to the stators with a thickness of 450-500μ.

In lieu of RILSAN® polyamide, we have found that a suitable functional polyester-epoxy resin from AKZO Nobel—France (AKZO Nobel Powder Coatings, ZI de la Gaudrée BP67, 91416 Dourdan cedex, France) can be applied. We have modified the material by the addition of 2% carbon black to provide sufficient conductivity in the coating, so as to cause (among other things) the stator when in use to exhibit a static charge on the outer surface of the coating.

In yet another embodiment, we use a double curable (such term in this description meaning using IR plus UV) powder coat. Such a powder coating can be very thin, such as 150-200μ which makes the resulting electrostatic speaker approximately 2 db more sensitive than typical prior art electrostatic speakers. Furthermore, the powder coating enables the speakers to withstand higher stator voltages than prior art electrostatic speakers can withstand. Double curable powder coating can also be used on other stator materials, such as printed circuit board (PCB) material. In using this materials, typically one may expose the stator to which has been applied the material to baking at 90° C. and UV curing for a period of, for example, 5 to 10 seconds. Additional information concerning such processes may be found at http://www.dsm-.com/en_US/downloads/dcr/UV_Cure_PC_Resins.pdf, which is incorporated herein by reference. This material finds normal application as an environmental coating where a high dielectric strength is also desired.

Alternatively, the stators are made of glass fiber reinforced epoxy sheet—or any other printed circuit board material. Glass fiber reinforced epoxy sheet is less expensive to make and lighter in weight than steel, and is not subject to corrosion. Above all glass fiber reinforced epoxy sheet is an isolator itself. However, at least portions of the plastic stator must be made electrically conductive. In one embodiment, holes are drilled or punched after the board has been formed with the conductive layer. The conductive layer, which may be a metal sheet or other suitable material, need not be thick enough to support itself, the die cast plastic provides sufficient mechanical rigidity. The metal sheet needs only to be thick enough to provide a conductive layer over or within at least a portion of the stator. In contrast, a punched steel stator typically is thick enough to support itself in normal use without warping or collapsing. If the thin metal sheet is attached to an outer surface of the plastic, the metal sheet can be powder coated, as described above. Techniques for forming die cast plastic with a thin metal layer are known in the printed circuit board (PCB) industry.

We have found that suitable double curable coatings for PCB-based stators can be used in the same way as described above for metal stator plates. Alternatively, we have achieved satisfactory results with Parylene coating in approximately 60μ thickness (providing insulation to 15 kV) along with a thin layer of black coating for cosmetic and electric charging reasons. The Parylene coating is applied in a manner using vacuum deposition as described at http://www.paratechcoating.co.uk/parylenewhat.php, which is incorporated herein by reference. We have also achieved satisfactory results using double cure black solder mask (BSM), of a type including about 2% carbon black, having a dielectric strength of 70-100 KV per mm; in this procedure, four to six layers of UV curable solder mask are applied by screen printing, and each screen print is followed by a thermal cure at 100° C. and UV cure for 5 to 10 seconds.

Alternatively, the stator is made of a multi-layer, injection-molded material, in which one of the layers is conductive, and that is cast with a plurality of holes therethrough. For example, a glass fiber filled material can be used for one of the layers to provide mechanical rigidity. The conductive layer can be any thickness, although a thin conductive layer is preferred. The conductive layer can be on an outside surface of the stator, or the conductive layer can be sandwiched between two or more layers of other (such as non-conductive) material. If the conductive layer is on an outside surface of the stator, the conductive layer can be powder coated with a double curable powder coat.

The conductive material layer can be made of metal, such as a sheet, a plurality of metal flakes or a wire oriented raster-like in the layer. Alternatively, the conductive layer can be made of conductive plastic, a plurality of non-conductive plastic flakes that are coated with a conductive material or another suitable material. An example of a material having conductive particles dispersed therethrough is disclosed in U.S. Pat. No. 7,049,836, entitled "Anisotropic conductivity connector, conductive paste composition, probe member, and wafer inspection device, and wafer inspecting method," filed Aug. 7, 2003, the contents of which are hereby incorporated herein.

Alternatively, the die cast plastic can be screen printed with an electrically conductive layer, such as conductive ink. Optionally, the conductive layer is powder coated with a double curable powder coat, such as described above if needed to prevent the conductive layer from oxidizing or if a particular color surface on the stator is desired.

In yet another embodiment, the stator is made of conductive plastic, which is optionally powder coated with a double curable powder coat.

While it is common to use hole densities that are uniform across the area of the stators between which the diaphragm moves, in accordance with a further embodiment of the present invention, the hole density of one or both of the stators is varied so as to provide a desired amount of damping of motion of the diaphragm. For example, it is sometimes desired to dampen the motion of the portion of the diaphragm lying midway between two spacer elements, and such damping may be achieved by reducing the density of holes in that region. The density may be affected by maintaining the spacing of holes but decreasing their size, or by increasing the spacing of holes and maintaining their size, or by a combination of changes in spacing and size of holes.

Speaker Assembly

Figure 9:
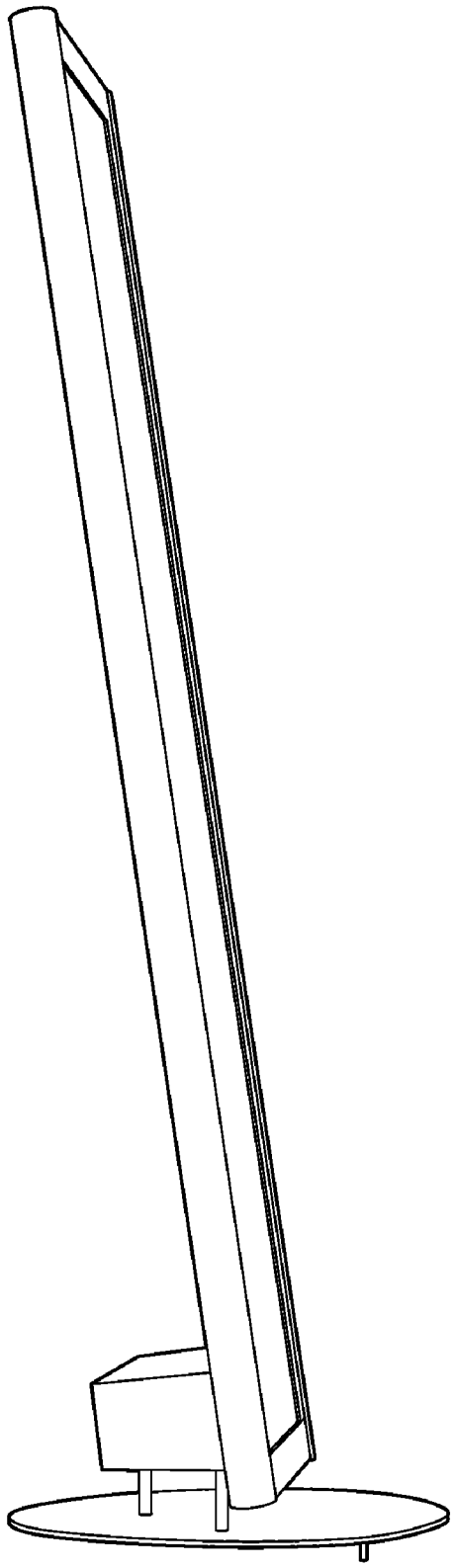
FIG. 9 is a perspective view of an embodiment of the present invention wherein a driver circuit of the general type illustrated (for example) in FIGS. 25-27 is incorporated in a housing at the base and on the back side of an electrostatic speaker of a design similar that of FIGS. 1-6.
Figure 10:
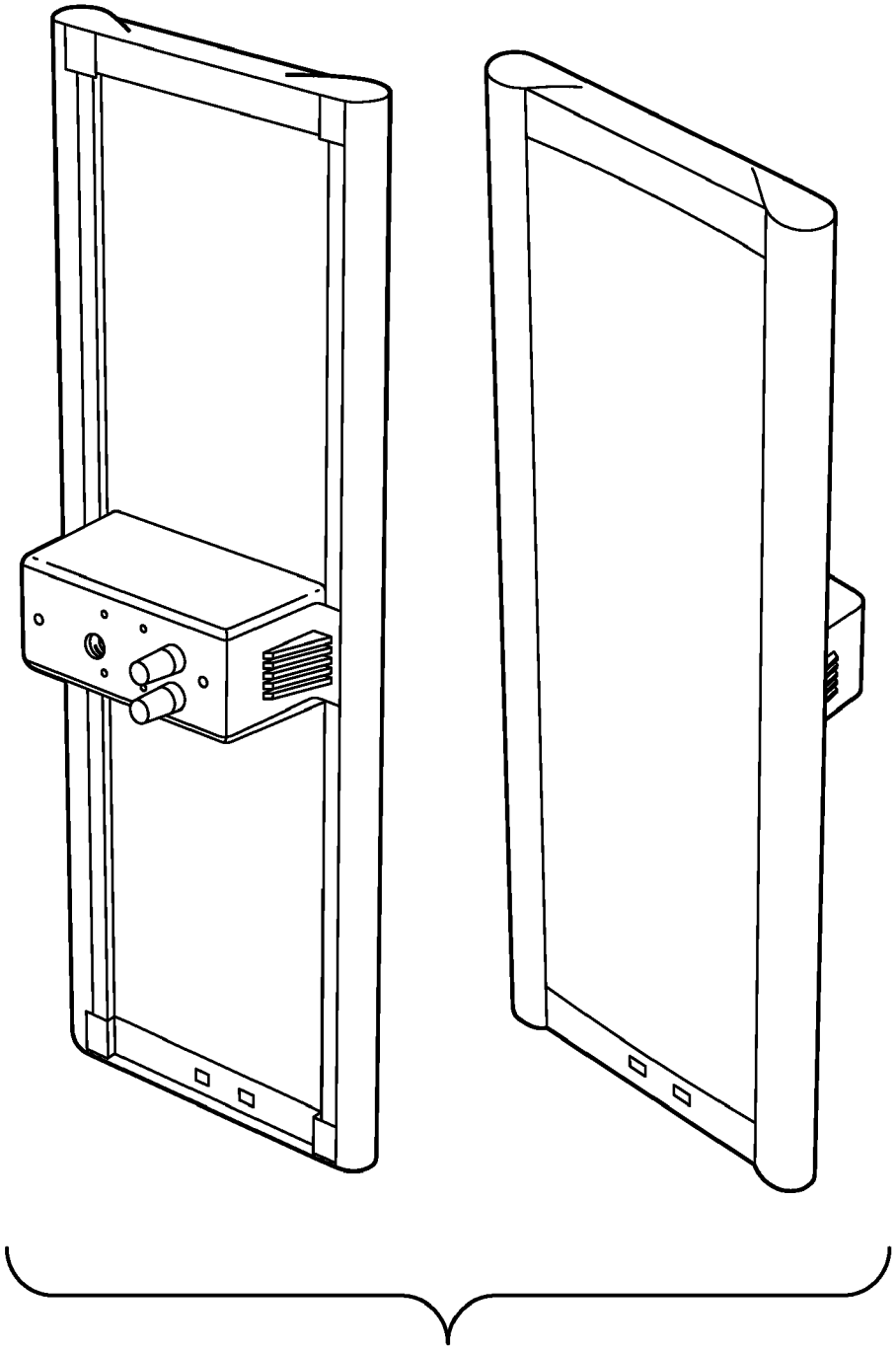
FIG. 10 presents two perspective views of a related embodiment of the present invention, wherein the driver circuit is incorporated in a housing on the back side of an electrostatic loudspeaker of a design similar that of FIGS. 1-6, wherein the housing is disposed at a midpoint of the long dimension of the loudspeaker.

FIG. 9 is a perspective view of an embodiment of the present invention wherein a driver circuit of the general type illustrated (for example) in FIGS. 25-27 (discussed below) is incorporated in a housing at the base and on the back side of an electrostatic speaker of a design similar that described above. FIG. 10 presents two perspective views of a related embodiment of the present invention, wherein the driver circuit is incorporated in a housing on the back side of an electrostatic loudspeaker of a design similar that described above, but wherein the housing is disposed at a midpoint of the long dimension of the loudspeaker. In the embodiment of FIG. 10, when the loudspeaker is of moderate size in its long dimension (for example approximately 1 meter or less), it is sometimes convenient to mount the loudspeaker to the wall using the housing for the driver circuit for physical attachment to a wall mount or other suitable mount.

Spacer Design

Figure 11:
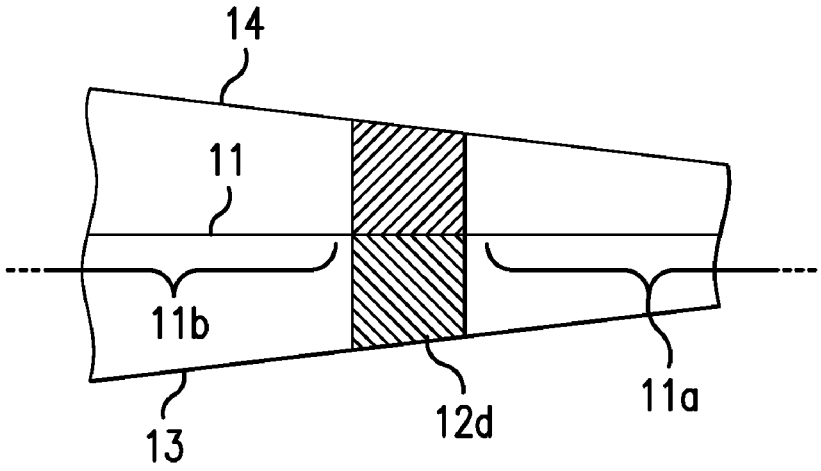
FIGS. 11-17 are cross sections of various spacer implementations in accordance with embodiments of the present invention for use with the system of FIG. 1 or with parallel stators.

Optionally, all or a portion of some or all of the spacers 12*a-e* of FIG. 1 are made of rigid, flexible or soft material or a combination thereof. A portion 15 of the electrostatic speaker of FIG. 1 is shown enlarged in each of FIGS. 11-17. FIG. 11 shows the spacer 12*d* made of a rigid material, such as Forex® closed cell rigid PVC foam, available from ALCAN AIREX AG (Sins, Switzerland). Alternatively, the spacer 12*d* can be made of a flexible material, such as rubber. Alternatively, the spacer 12*d* can be made of a soft material, such as foam.

Typically, the diaphragm 11 is mounted between the spacers 12*a-e*, such that the diaphragm 11 is under tension, or at least not loose. Consequently, the diaphragm 11 can have a resonant frequency that is characteristic of its mass, material, size, tension, etc. Such a resonant frequency is generally undesirable, because it can cause the electrostatic speaker to have a non-flat frequency response. That is, the resonant frequency tends to boost the sound output of the electrostatic speaker unequally, favoring signals close to or at the resonant frequency and possibly sub-harmonics of the resonant frequency. Such resonances can sometimes be useful at the lowest frequencies to be reproduced; however, resonances at higher frequencies are generally undesirable.

In addition, the diaphragm 11 may experience larger excursions when driven at the resonant frequency than when driven at other frequencies. These larger excursions may cause the diaphragm 11 to come into contact with one or both of the stators 13 and 14. Mounting the diaphragm 11 between spacers that are wholly or partly flexible or soft dampens the excursions of the diaphragm 11 at its extremities, thus reducing or eliminating the resonant frequency effect. Such spacers are referred to herein as "dampening spacers." The dampening spacers lower the quality (or Q factor) of the diaphragm 11, thus the damping spacers reduce the diaphragms' response to their respective resonant frequencies.

Figure 12:
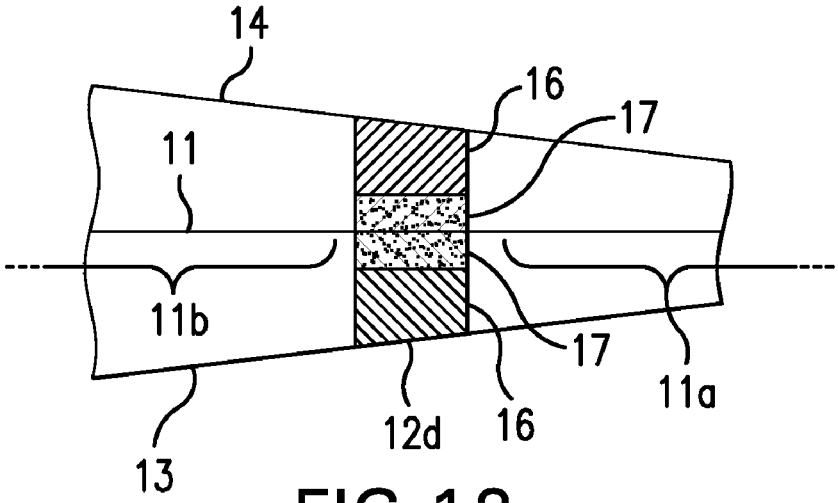

FIG. 12 shows another embodiment of the spacer 12*d*. In this case, the dampening spacer 12*d* includes a rigid portion 16 and a flexible portion 17. Alternatively, the portion 17 can be made of a soft material.

Figure 13:
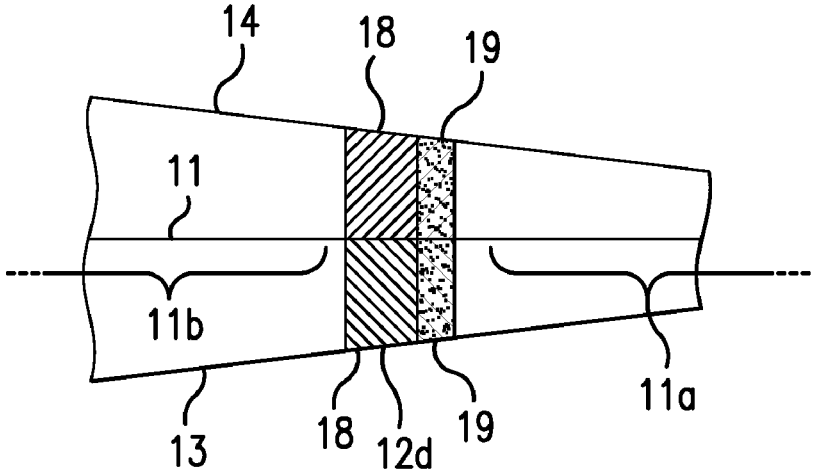

FIG. 13 shows yet another embodiment of the dampening spacer 12*d*. In the embodiment shown in FIG. 13, the spacer 12*d* includes a rigid portion 18 and a flexible or soft portion 19. It should be noted that the flexible or soft portion 19 of the spacer 12*d* is adjacent the portion 11*a* of the diaphragm 11 that reproduces high frequencies. The portion of the spacer 12*e* (not shown in FIG. 13) that is adjacent the diaphragm 11 is also preferably made of a flexible or soft material.

Diaphragms 11 that reproduce high frequencies benefit more from being mounted with dampening spacers than diaphragms that reproduce low frequencies. However, dampening spacers can also be used with diaphragms that reproduce low frequencies. Dampening spacers can be used in electrostatic speakers having one or more sections.

Figure 14:
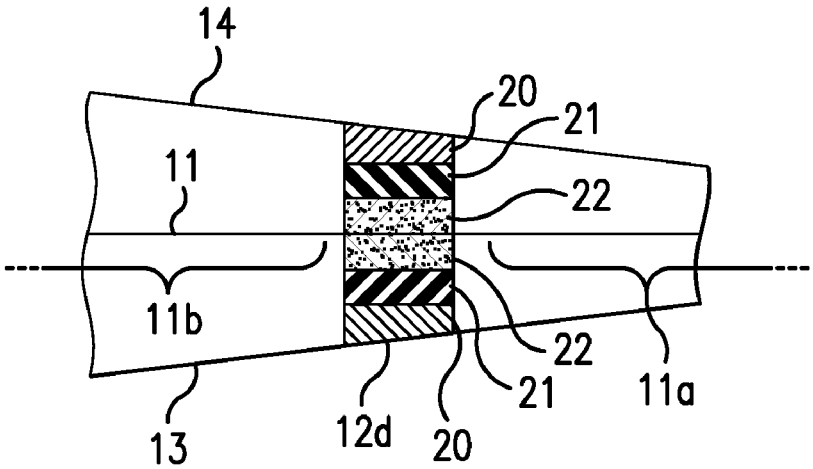

FIG. 14 shows yet another embodiment of the dampening spacer 12*d*. This embodiment includes three different layers, each being made of a material having a different rigidity modulus. For example, layer 20 is made of a rigid material, layer 21 is made of a flexible material and layer 22 is made of a soft material, i.e., a material that is less rigid than that of layer 21.

Figure 15:
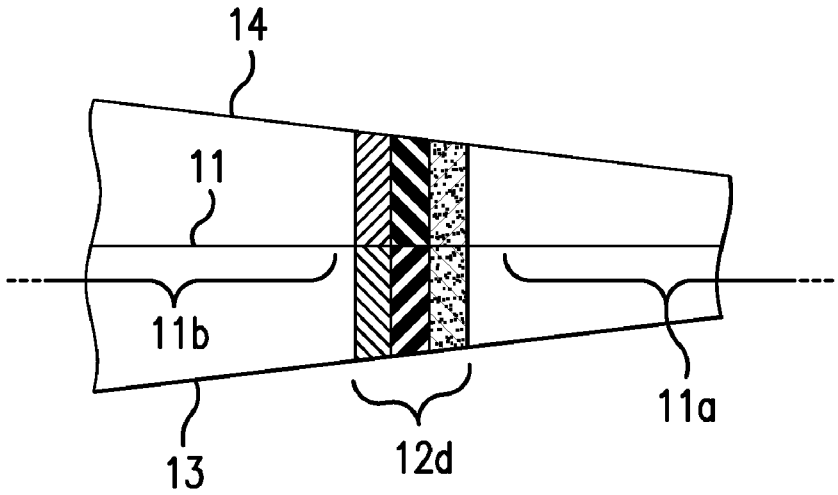

As shown in FIG. 15, an embodiment similar to that shown in FIG. 13 can include more than two layers of material having different rigidity moduli.

Figure 16:
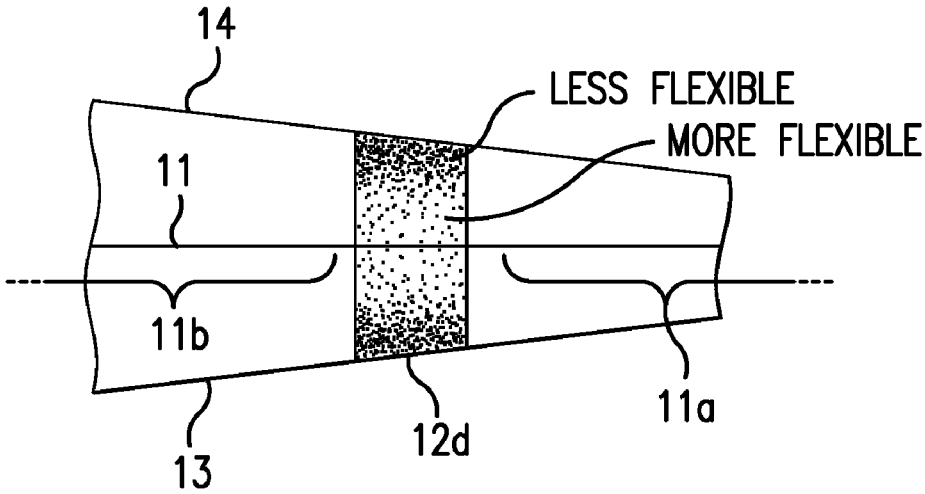
Figure 17:
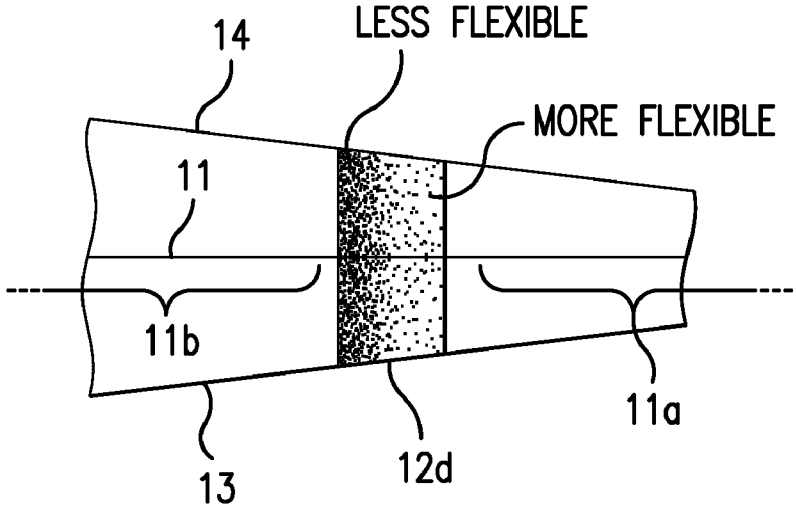

Alternatively, rather than a layered structure, the dampening spacer 12*d* can be made such that its rigidity varies continuously through its thickness, i.e., from the stator 14 or 13 to the diaphragm 11, or through its width, as shown in FIGS. 16 and 17.

Figure 18:
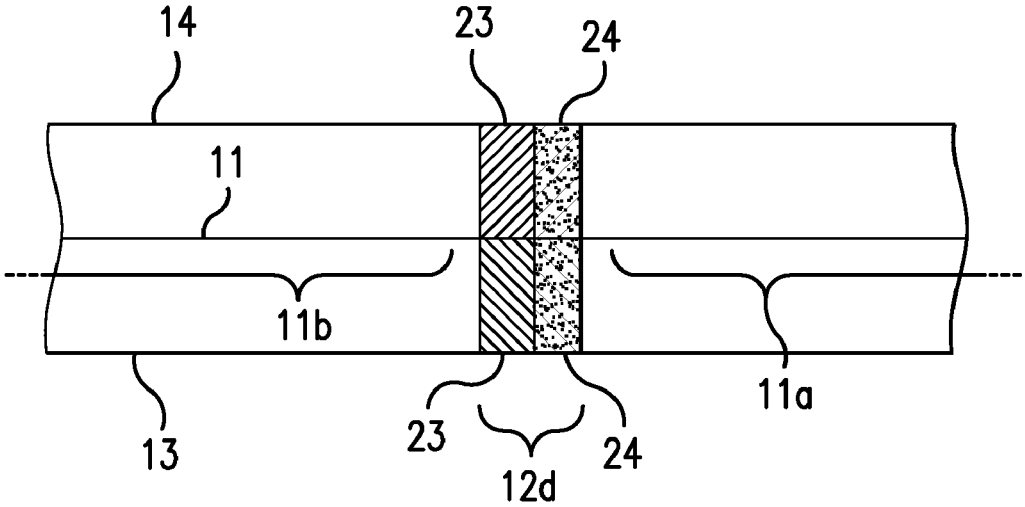
FIG. 18 shows an implementation of a spacer using adjacent rigid and soft portions in accordance with another embodiment of the present invention.

Dampening spacers can also be used in electrostatic speakers that include parallel stators, as shown in FIG. 18. Here, the spacer 12*d* includes a rigid portion 23 and a flexible or soft portion 24; however, all the structures and combinations described above, with respect to FIGS. 11-17, are equally applicable to electrostatic speakers with parallel and non-parallel stators.

Thus far we have considered spacers that are parallel. FIGS. 2 and 3 show electrostatic speakers having parallel spacers. For example, in FIGS. 2 and 3, the speakers and the spacers are vertically oriented. The spacers separate the diaphragm into portions. If the spacers are parallel, each portion of the diaphragm has a uniform width (along its length, such as from top to bottom), and the portion has a single self-resonant frequency.

Figure 19:
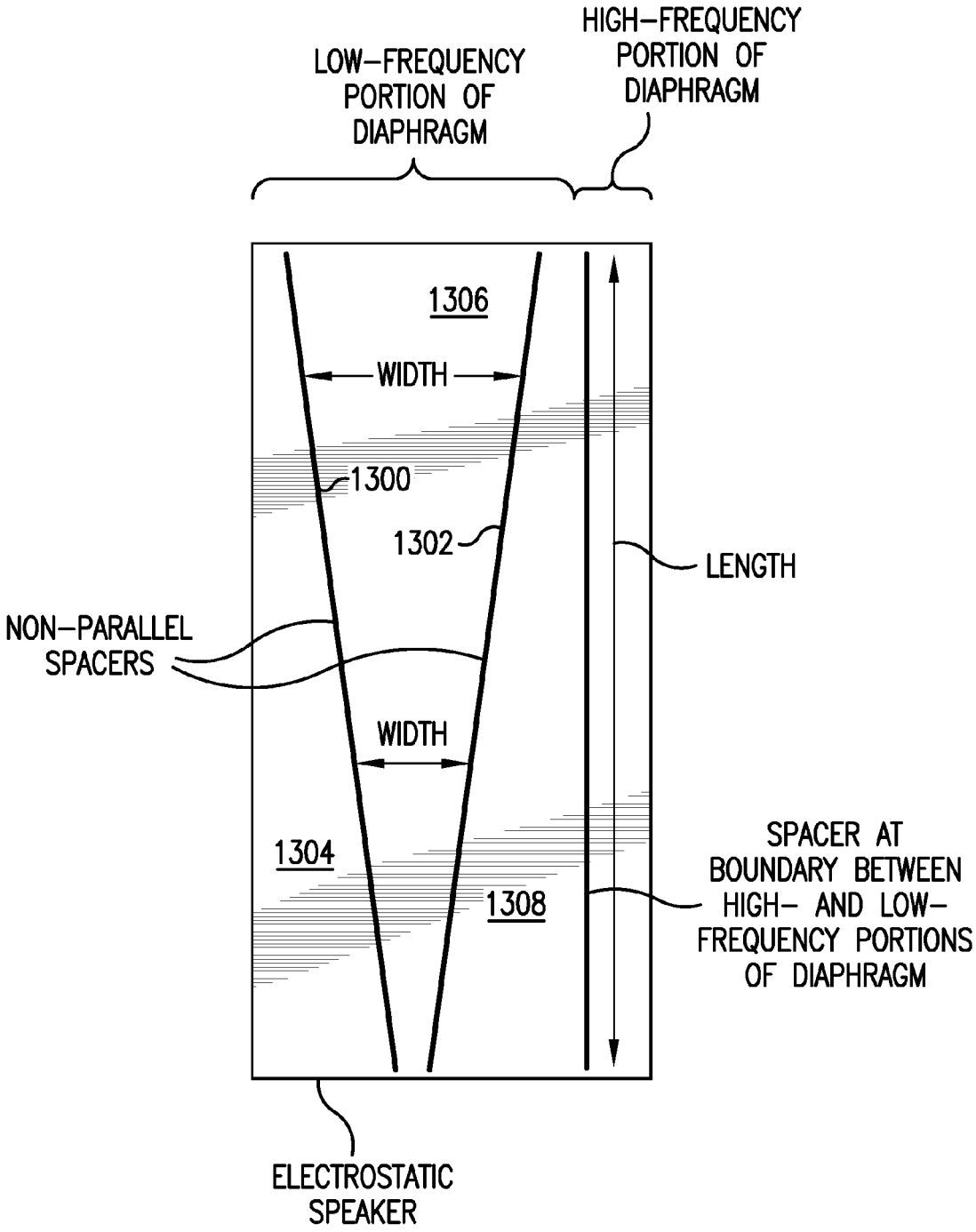
FIGS. 19 and 20 show use of non-parallel spacers and non-linear spaces respectively in accordance other embodiments of the present invention.

Alternatively, as shown in FIG. 19, the spacers are non-parallel. For example, spacers 1300 and 1302 are not parallel. The spacers 1300 and 1302 divide the diaphragm into portions 1304, 1306 and 1308. Because the spacers 1300 and 1302 are not parallel, the widths of the portions 1304-1308 vary along the lengths of the portions. For example, the portion 1306 of the diaphragm is wider at its top than at its bottom. The self-resonance frequency of the diaphragm portions depends on the dimensions of the portions. Consequently, varying the width of a diaphragm portion, such as 1306, varies the self-resonance frequency along the length of the portion. Thus, the top, middle, and bottom (for example) parts of the portion 1306 of the diaphragm resonate at different frequencies. Distributing the resonances across a frequency range reduces the amplitude of any one of the resonant frequencies. If, on the other hand, the portion 1306 had a uniform width along its length, the entire portion 1306 would resonate at a single frequency.

Figure 20:
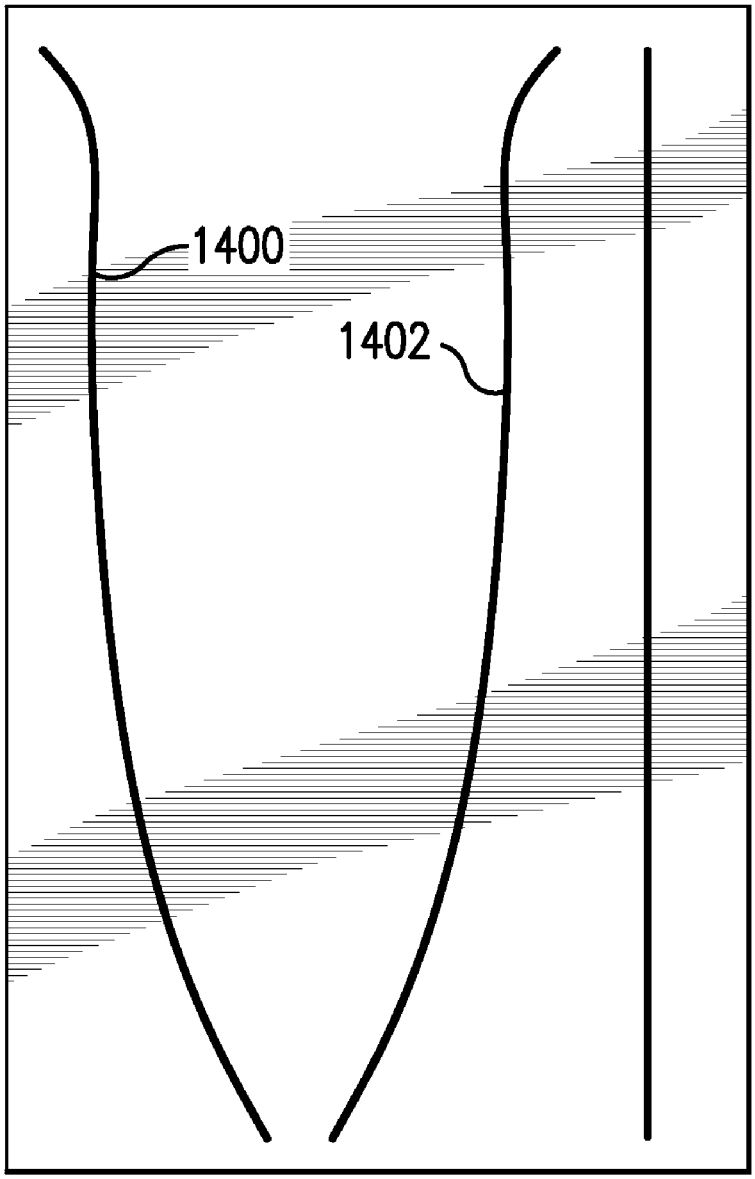

Optionally, the spacers need not be linear. For example, as shown in FIG. 20, spacers 1400 and 1402 are non-linear. Although the spacers 1400 and 1402 are shown as being symmetric, the spacers can be asymmetric. Similarly, any number of spacers can be used in a single electrostatic speaker.

Figure 21:
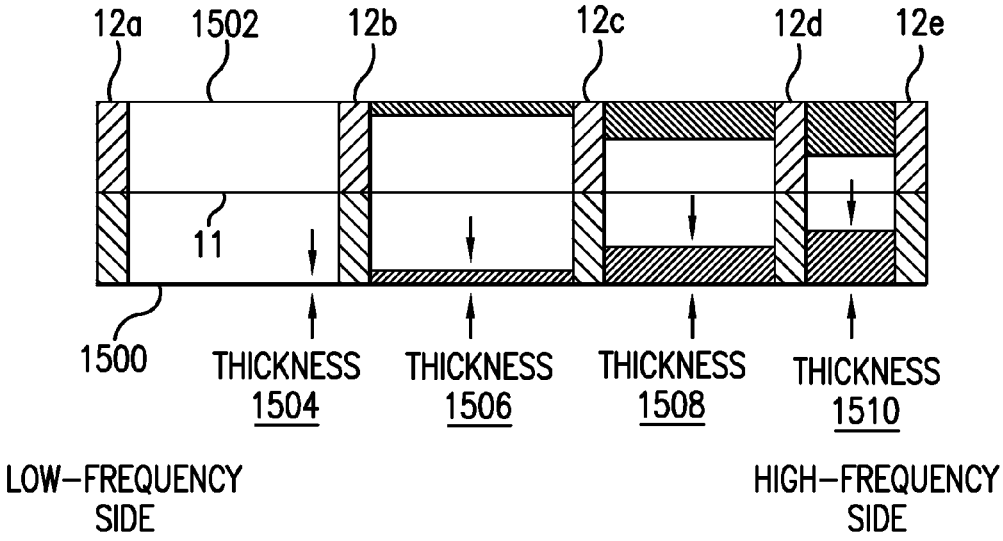
FIGS. 21-24 show cross section of arrangements for mounting the stators parallel to the diaphragm while achieving closer stator spacing for high frequency portions of the system.

Other arrangements than those shown in FIG. 1 can be used to achieve varying spacing between the stators. FIGS. 21-24 show cross section of arrangements for mounting the stators parallel to the diaphragm while achieving closer stator spacing for high frequency portions of the system. For example, as shown in FIG. 21, the thickness of the stators can vary across the width of each electrostatic speaker. FIG. 21, like FIG. 1, is a cross-sectional view of an electrostatic speaker, according to one embodiment of the present invention. Rather than having non-parallel stators 13 and 14, as in FIG. 1, the stators 1500 and 1502 are parallel. However, the thickness of the stators varies in steps across the width of the electrostatic speaker. For example, thicknesses 1504, 1506, 1508 and 1510 can progress in steps from 0.8 mm to 2.0 mm. Other thicknesses can, of course, be used. Thus, the diaphragm-to-stator spacing is greater in the portion of the electrostatic speaker that is to reproduce low frequencies than in the portion that is to reproduces high frequencies.

Figure 22:
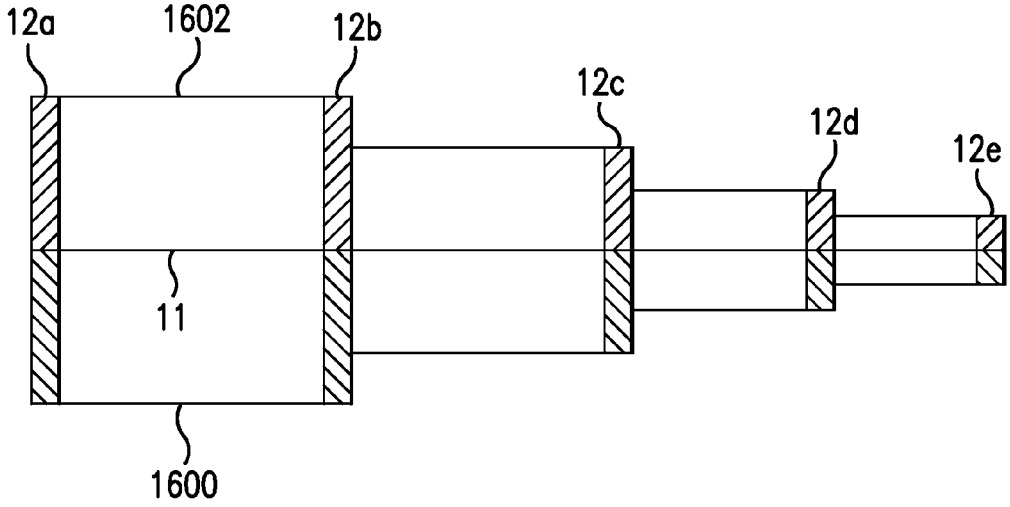

Alternatively, as shown in FIG. 22, the thickness of the stators can remain constant, and the stators 1600 and 1602 can be stepped in relation to one another, so that stator spacing in successive speaker portions, considered moving to the right, correspondingly decreases.

Figure 23:
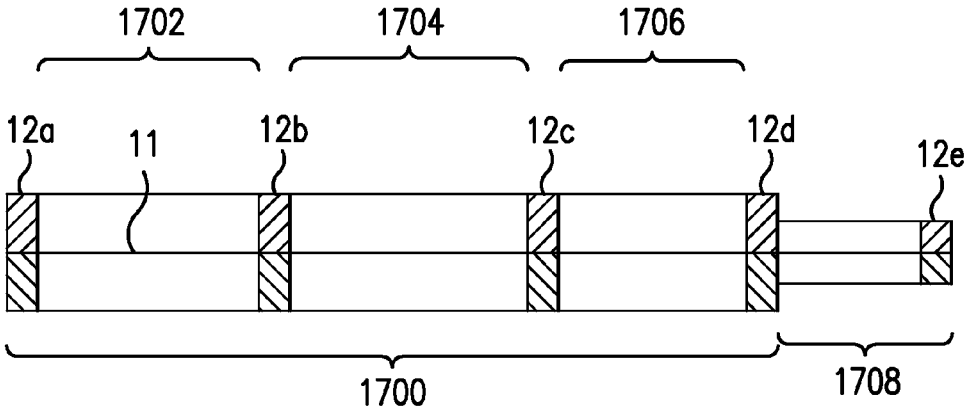

Some of the previously described embodiments have multiple, parallel-stator portions, each having a different inter-stator spacing. Alternatively, as shown in FIG. 23, several portions of the electrostatic speaker can have identical inter-stator spacings. For example, a low-frequency portion 1700 has several portions 1702, 1704 and 1706, all having the same inter-stator spacing, and a high-frequency portion 1708 has a smaller inter-stator spacing.

As noted, the stator of an electrostatic speaker can be partitioned into regions, each region having a different stator-to-diaphragm spacing. All of these regions can be electrically connected together and supplied with a common high DC voltage. Alternatively, each of these regions can be electrically isolated from the other regions, and each region can be supplied with a different voltage. For example, each stator can include a printed circuit board (PCB) with a separate copper cladding for each region.

The regions with larger stator-to-diaphragm spacings are supplied with higher voltages than the regions with smaller stator-to-diaphragm spacings. For example, in the electrostatic speaker shown in FIG. 21, the region with the largest stator-to-diaphragm spacing (i.e., the region between spacer 12*a* and spacer 12*b*) is supplied with 4,000 V DC; the next region with the second largest spacing (i.e., between spacers 12*b* and 12*c*) is supplied with 3,000 V DC; the next region (i.e., between spacers 12*c* and 12*d*) is supplied with 2,500 V DC; and the region with the smallest stator-to-diaphragm spacing (i.e., between spacers 12*d* and 12*e*) is supplied with 2,000 V DC. Other voltages can be used, depending on the stator-to-diaphragm spacing, coating (if any) on the stator, insulating coating (if any) on the diaphragm, etc.

Figure 24:
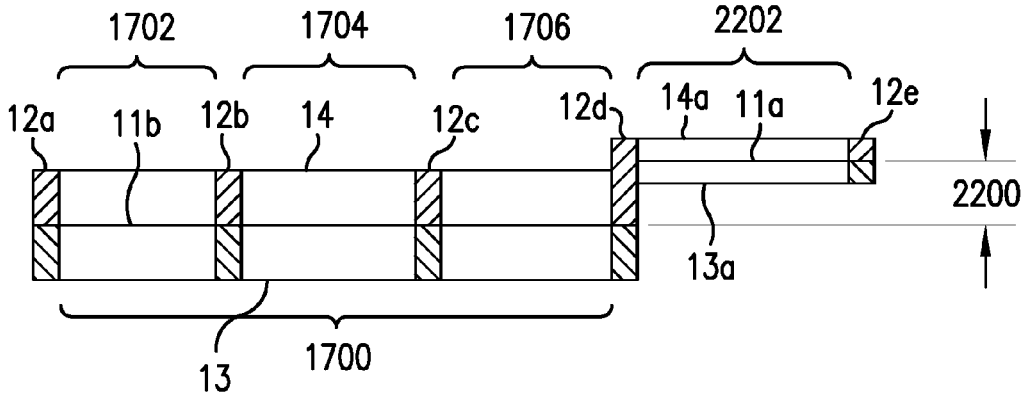

Some electrostatic speakers according to embodiments of the present invention compensate for the differences in the delay characteristics of the filters by displacing one or more sections of the electrostatic speaker, relative to other sections of the speaker, as shown in FIG. 24. For example, the diaphragm 11*a* in the high-frequency section 2202 of the speaker is displaced a distance 2200, relative to the diaphragm 11*b* of the low-frequency section 1700. This displacement 2200 increasing the distance over which the high-frequency acoustic signal (sound) travels through air from the speaker to the listener. The diaphragm sections 11*a* and 11*b* can be part of one continuous diaphragm that is separated into two or more electrically isolated portions or the two diaphragm sections 11*a* and 11*b* can be separate diaphragms. The front and rear stators 13 and 14 can be electrically connected to respective front and rear stators 13*a* and 14*a*, between which the high-frequency diaphragm section 11*a* is disposed. Alternatively, the front and rear stators 13*a* and 14*a* can be electrically isolated from the other stators 13 and 14; in which case the high-frequency stators 13*a* and 14*a* are separately powered.

Sound travels at a speed of approximately 330 m/Sec. through air. Thus, sound travels about 8.25 cm in 0.25 mSec. Continuing the previous example, to compensate for a 0.25 mSec. difference in delay characteristics, the high-frequency section 2202 is located about 8.25 cm further from the listener than the low-frequency section 1700. Consequently, the high-frequency and the low-frequency sounds arrive at the listener at the same time, even though the high-frequency sounds travel a longer distance.

This type of compensation can be of particular value in virtual surround sound systems, in which small differences in sound arrival times (as perceived by a listener) can play a significant role in the apparent source (location) of the sounds. In speakers that are fed by circuits with more than two different delay characteristics, each section of the speaker can be displaced a different distance, relative to the other sections.

Driver Circuitry and Safety Features

Figure 25:
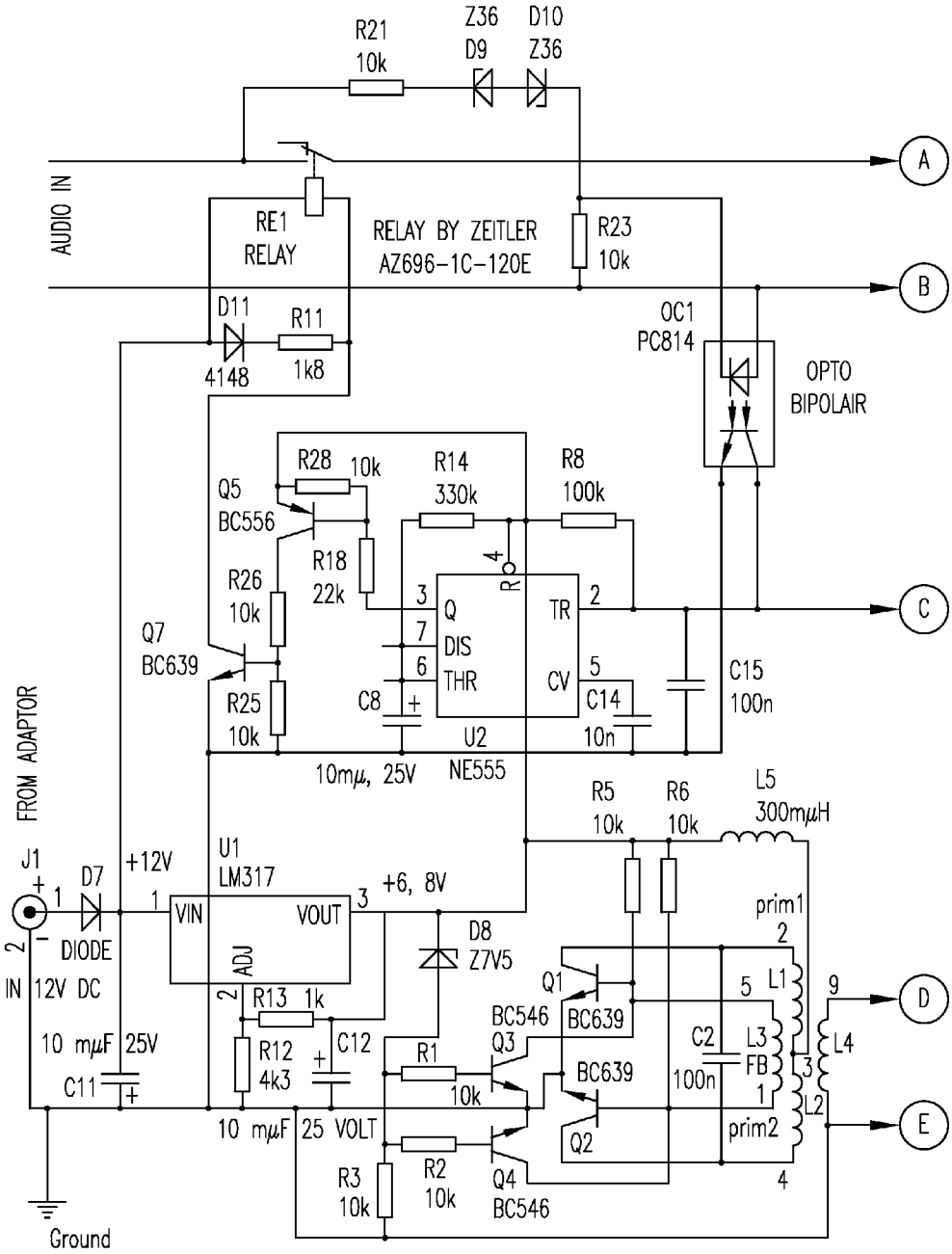
FIGS. 25-27 presents a schematic of a circuit, in accordance with an embodiment of the present invention, for driving a loudspeaker embodiment of the type illustrated in the previous figures.
Figure 26:
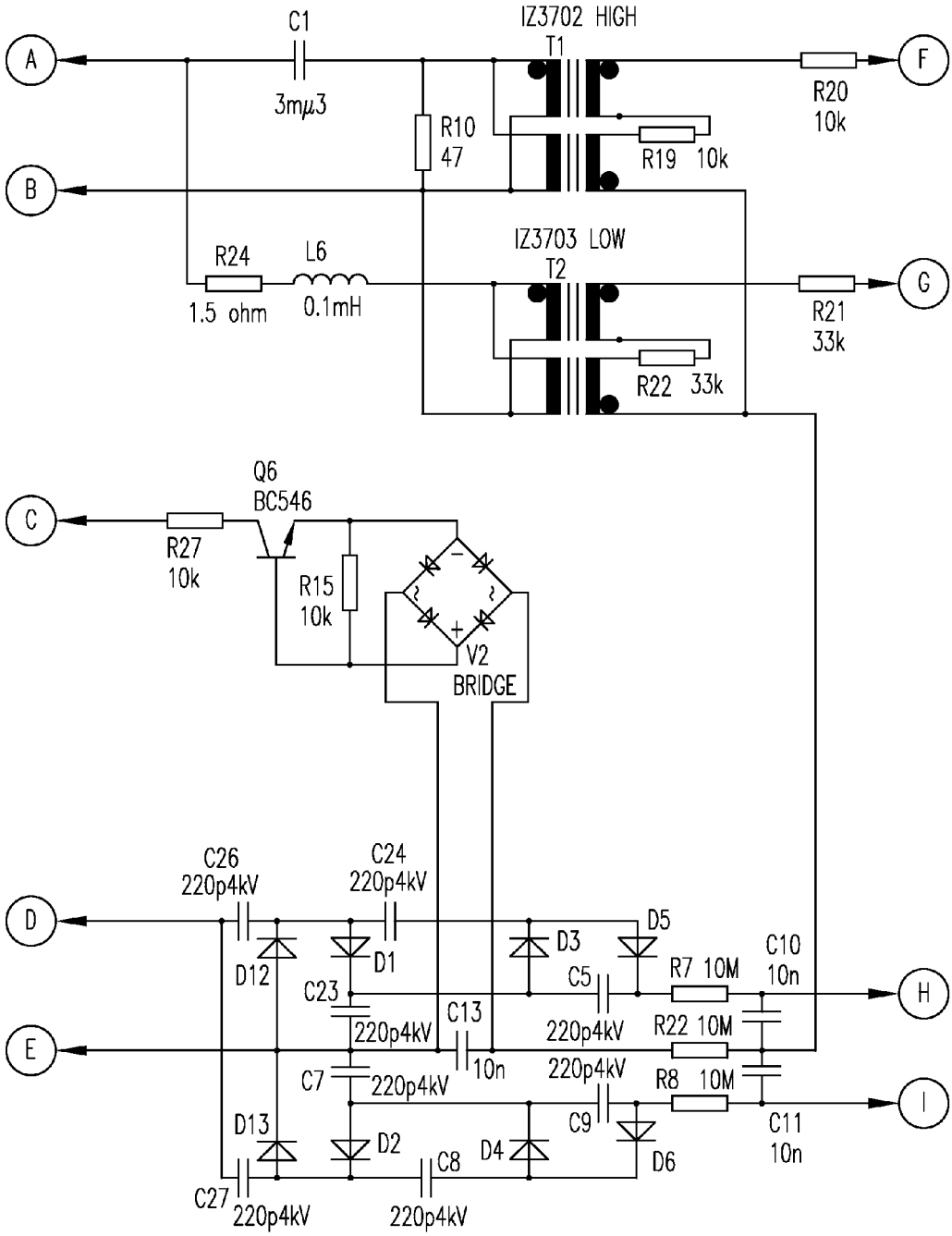
Figure 27:
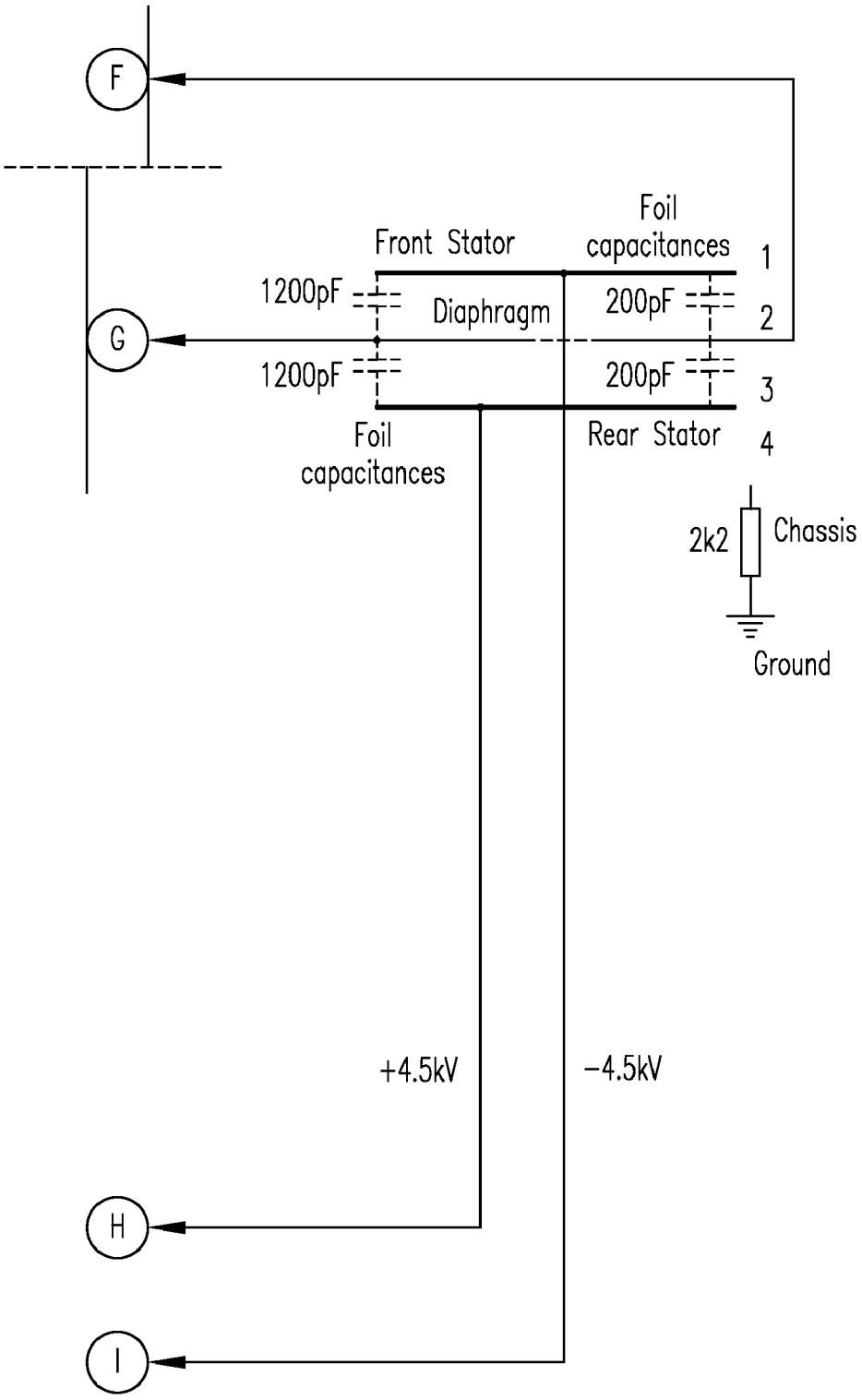

FIGS. 25-27 presents a schematic of a circuit, in accordance with an embodiment of the present invention, for driving a loudspeaker embodiment of the type illustrated in the previous figures. As described in the literature referred to in the beginning of this application, the schematic of FIGS. 25-27 uses an inverter design to keep the diaphragm at a 0 volt DC level relative to the stators. In contrast to the inverter design described in the above literature, however, the present embodiment provides a separate output for each section of the loudspeaker diaphragm. The design, as seen in FIG. 26, provides a first output from transformer T1, subject to a high-pass filter implemented by series capacitor C1 in the input to transformer T1, for the high frequency section of the loudspeaker (shown in FIG. 27 through connection node F) and a second output from the transformer T2, subject to a low-pass filter implemented by series inductor L6 in the input to transformer T2, for the lower frequency section of the loudspeaker (shown in FIG. 27 through connection node G).

The circuit depicted in FIGS. 25-27 may be characterized in a more general way. The electronic circuit comprises an audio filter to which the audio signal is supplied. This audio filter is adapted to provide appropriate band-pass filtering to adapt the signal to the requirements of the pertinent section of the loudspeaker. The signal is then supplied to the step up transformer to reach the voltage level required to drive the loudspeaker. As explained later, it is also possible that the amplifier is adapted to generate output signals of which the voltage is sufficiently high to drive the loudspeaker without the use of a step up transformer. Also, the audio filter may contain feedback circuits to perform functions to be described later.

To provide high voltage DC to the stators (at nodes H and I of FIG. 27), a high voltage power supply is provided (illustrated in FIGS. 25 and 26), which contains a DC-to-AC power inverter to convert a supplied voltage, such as 12V DC, to an AC voltage and a transformer to convert this AC voltage to the required voltage level (at nodes D and E of FIG. 25), which is supplied to the loudspeaker after rectification and filtering. In FIG. 26, rectifiers are used to rectify the output voltage of the transformer to obtain plus and minus high voltage DC-power relative to a reference node with respect to which the high voltage audio signal is provided. These DC-voltages are further smoothed by low-pass filtering, also shown in FIG. 26.

An audio protection circuit is also provided that operates in conjunction with the audio filter and the DC high voltage power source. The function of this protection circuit is the detection of the presence of an audio signal and to switch off the high voltage when no audio signal has been present during a predetermined time. The switch-off of the high voltage on the speaker when it is not in use helps to reduce the collection of dust, moisture and particles on the elements of the speaker.

Further, the protection circuit provides for the detection of a sudden change in the charge on the elements of the loudspeaker, a circumstance that would occur, for example, if a person or an animal has brought a part of his or her body in the vicinity of the voltage-carrying parts of the loudspeaker, leading to a potentially unpleasant, but (due to the low available current) harmless experience. Of course the protection circuit is also adapted to provide for classic safety functions, such as protection against over-voltage and against a short circuit between the voltage carrying parts of the loudspeaker.

Figure 28A:
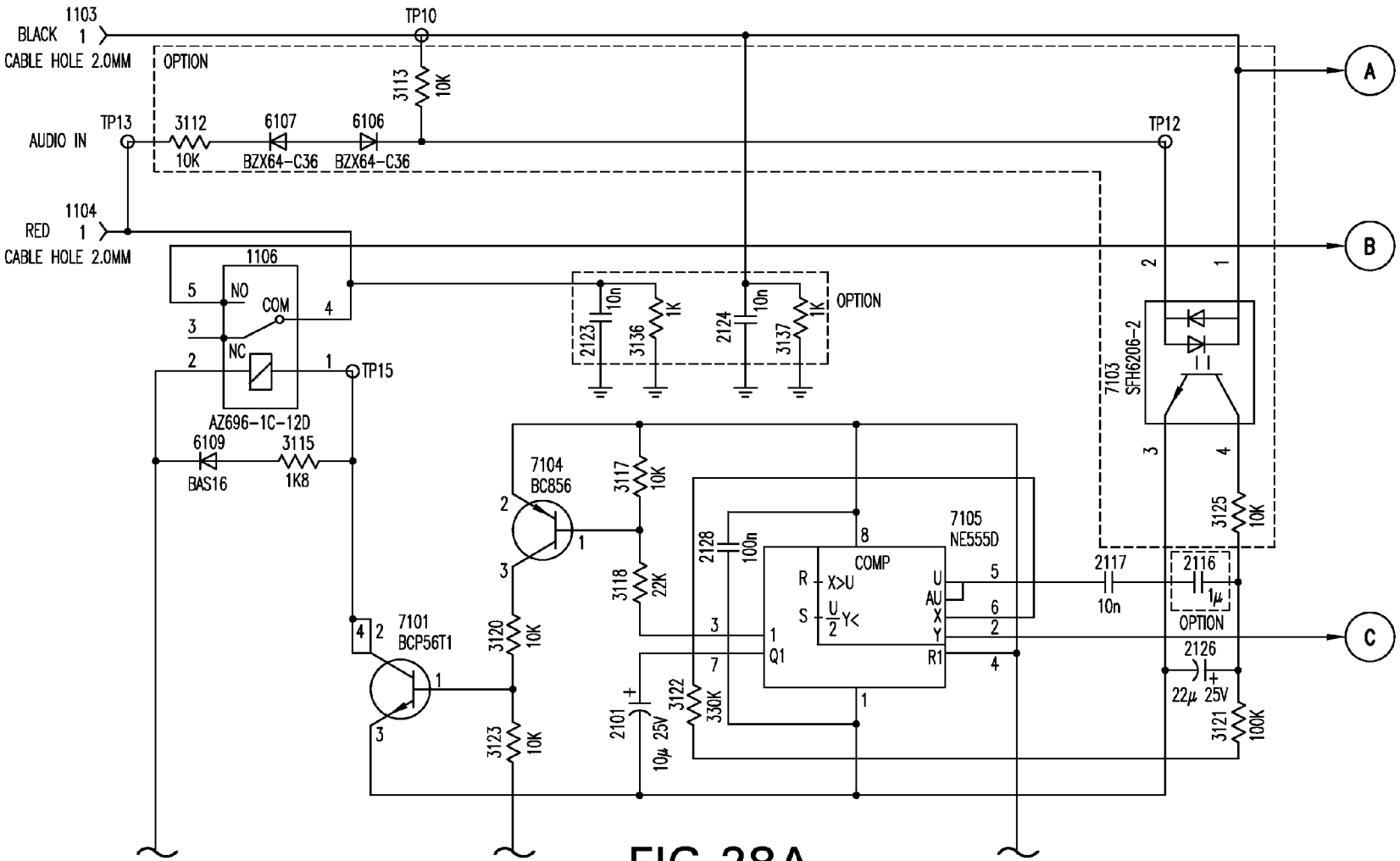
FIGS. 28-29 illustrate another circuit in accordance with an embodiment of the present invention and having functionality similar to that of the circuit of FIGS. 25-27.
Figure 28B:
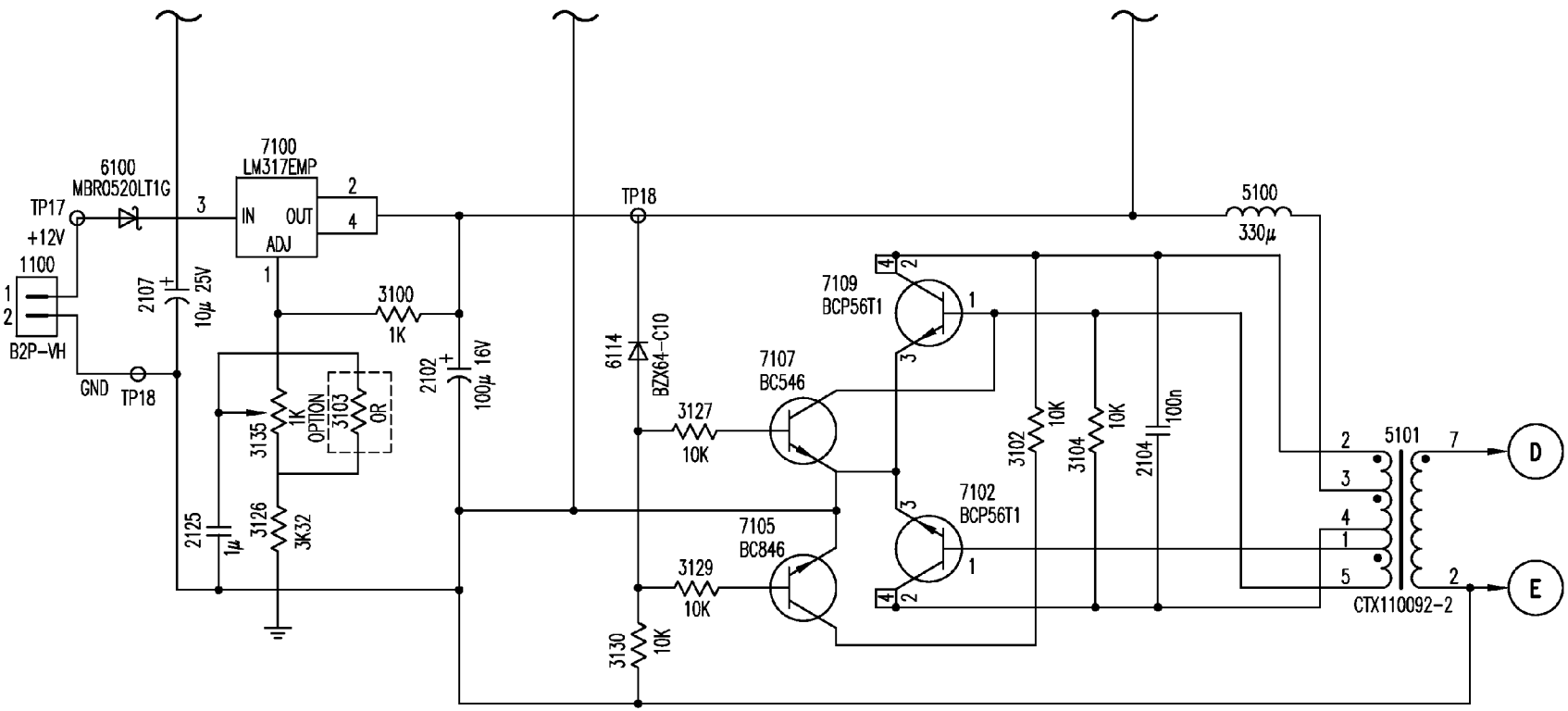
Figure 29A:
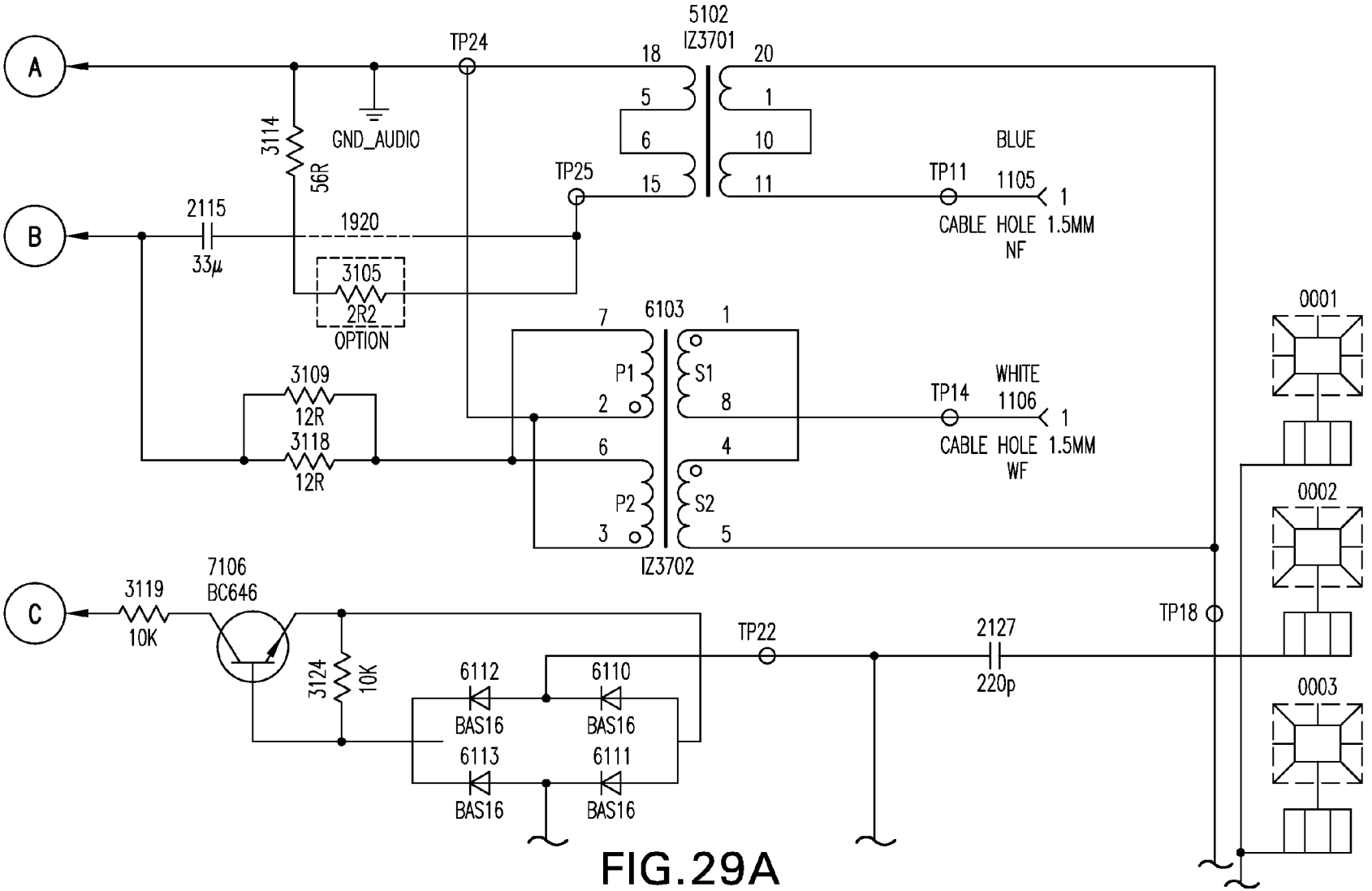
Figure 29B:
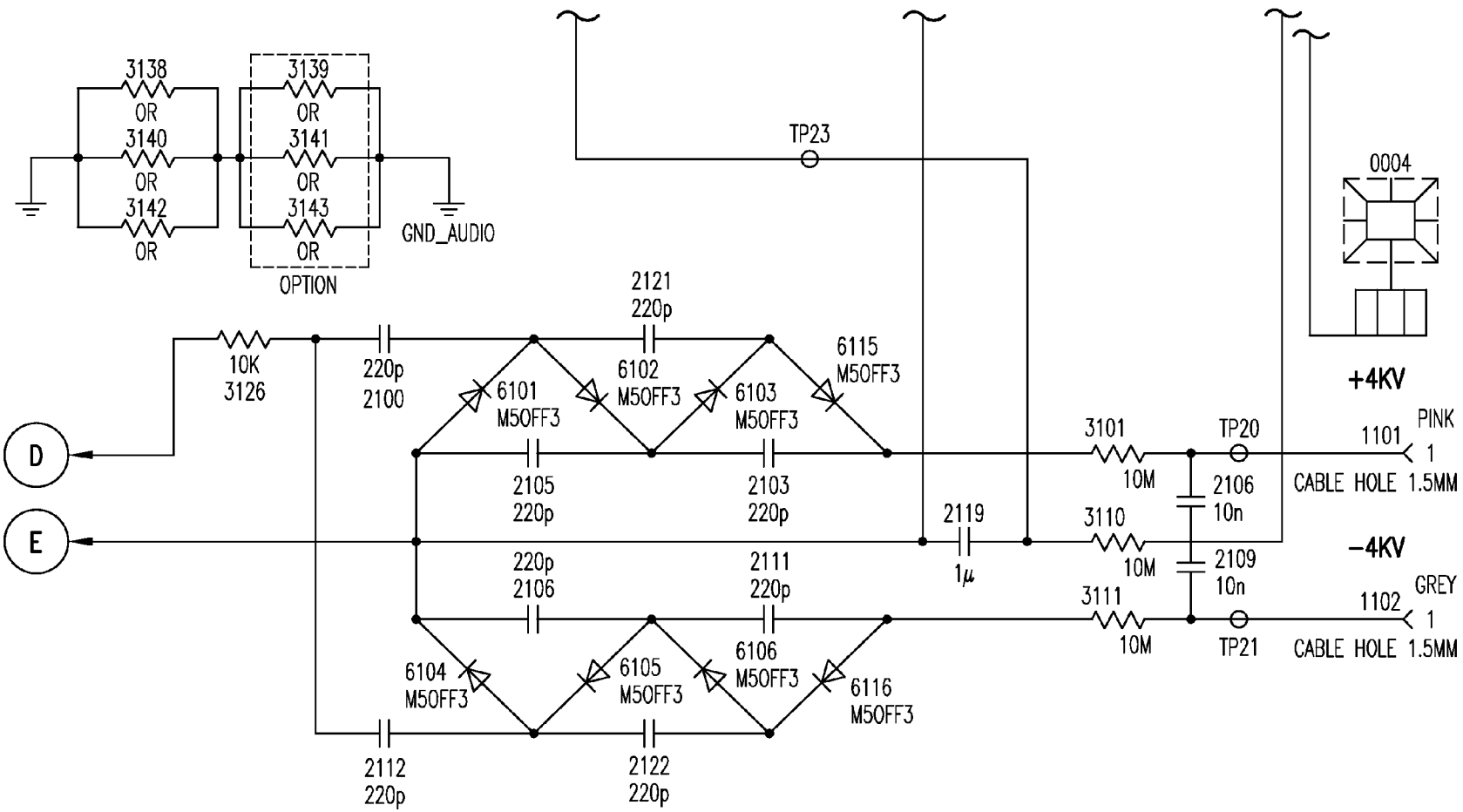

FIGS. 28-29 illustrate another circuit in accordance with an embodiment of the present invention and having functionality similar to that of the circuit of FIGS. 25-27. As shown in the schematic diagrams of FIGS. 25-27 and FIGS. 28-29, the protection circuit in these embodiments includes a timer (U1 in FIG. 25; 7105 in FIG. 28), such as an NE555. If a situation that warrants shutting off the high voltage to the stator is detected (as described below), the timer is triggered. When triggered, the timer produces a pulse having a predetermined duration, such as three seconds. The audio input is disabled for the duration of the pulse. The pulse, through transistors (Q5 and Q7 in FIG. 25; 7101 and 7104 in FIG. 28), releases a relay (RE1 in FIG. 25; 1108 in FIG. 28). Under normal circumstances, the relay is closed, allowing an audio signal from a source to be supplied to a step-up circuit. However, if the relay is released, the relay opens, and the audio signal is cut off. Operating the relay in this "normally closed" fashion (i.e., the relay contacts are closed during normal operation) is preferable to operating the relay in a "normally open" fashion (in which the relay would be energized when the audio signal is to be cut off), because the relay can be made to open faster than it can be made to close, and the system also operates in a fail-safe mode.

Various circuits and conditions can trigger the timer. For example, under normal circumstances, no current flows through a resistor (R22 in FIG. 25; 3110 in FIG. 28) in a 0-volt lead of the high-voltage section of the circuit. However, if a person comes into electrical contact with one of the stators or another one of the high-voltage components of the electrostatic speaker, a small current flows for a short time through the resistor. This current is a result of a discharge of the parasitic capacitance between the primary and the secondary windings of a transformer (T1 or T2 in FIG. 26; 5102 or 5103 in FIG. 29). This parasitic capacitance is small (approximately 100 pF), and the resistor has a value of about 10 M. Thus, the initial current through the resistor (and, therefore, into the person) is approximately 400 μA, and the RC time constant is approximately 1 mSec.

Similarly, if the diaphragm comes into electrical contact with one of the stators or into close enough physical proximity with one of the stators to cause a small current to flow therebetween, a current flows through the resistor. A diode bridge (V2 in FIG. 26; 6110, 6111, 6112 and 6113 in FIG. 29) detects a voltage across the resistor, and the diode bridge triggers the timer via a transistor (Q6 in FIG. 26; 7106 in FIG. 29). Functionally, this circuit operates similarly to a ground-fault interrupter. As noted above, the timer causes the audio input signal to be cut off for a predetermined period of time.

If the audio input signal exceeds a predetermined level, such as about 38 volts peak, for more than a predetermined period of time, such as about 10 mSec., another circuit triggers the timer. Zener diodes (D9 and D10 in FIG. 25; 6107 and 6108 in FIG. 28) detect the excessive audio signal level. The Zener diodes trigger the timer via an opto-isolator (OC1 in FIG. 25; 7103 in FIG. 28). The opto-isolator protects an audio amplifier or other signal source connected to the electrostatic speaker from high voltages that may be present in the protection circuits.

If the input DC power supply for the high-voltage power supply exceeds a predetermined voltage, Zener diode (D8 in FIG. 25; 6114 in FIG. 28), via transistors (Q3 and Q4 in FIG. 25; 7107 and 7108 in FIG. 28), switches off the transistors (Q1 and Q2 in FIG. 25; 7102 and 7109 in FIG. 28) that otherwise drive the inverter circuit that generates the high voltage.

To address Electromagnetic Compatibility (EMC) concerns, the enclosing conductive frame of the electrostatic speaker is at zero (volts) potential.

Although the schematics in FIGS. 25-27 and 28-29 show circuits that disable audio input signals from reaching the step-up transformers if the protection circuit is triggered and that disable the high-voltage supply if a DC supply voltage exceeds a threshold value, alternative protection circuits can be used. For example, if the protection circuit is triggered, the protection circuit can disable the high-voltage power supply, instead of disabling the audio input signal. Optionally or alternatively, the protection circuit can detect excessive current being drawn from the high-voltage supply, instead of excessive DC supply voltage being supplied to the high-voltage supply. If excessive current is drawn from the high-voltage supply, the protection circuit can disable the high-voltage supply. Other combinations of protection circuits are acceptable.

In the embodiment shown in the schematic diagrams of FIGS. 25-27 and 28-29, each electrostatic speaker circuit includes two transformers (T1 and T2 in FIG. 26; 5102 and 5103 in FIG. 29) in the audio signal step-up circuit. As shown in FIGS. 26 and 29, the primary windings of the transformers are connected together through respective high-pass and low-pass filters. That is, the inputs to the transformers are both derived from a single audio input.

Alternatively, each of the transformers can be connected to a separate audio source, such as a separate audio amplifier. In this case, the two audio amplifiers each amplify separate ranges of audio frequencies, an arrangement commonly known as bi-amplification.

A conventional or invertedly driven electrostatic speaker that includes an RC low-pass filter ahead of a step-up transformer exhibits a non-linear frequency response. The high-frequency response of the electrostatic speaker rises only about 3 db per octave, whereas the RC circuit exhibits a 6 db per octave roll-off. This mismatch results in a non-linear response curve of the combined system. Additional capacitors that are suitable for the high voltages present can be added in an attempt to achieve the desired response curve. However, such capacitors are expensive and generally do not yield satisfactory audio results. Furthermore, an electrostatic speaker with such additional capacitors presents a very low input impedance to a preceding amplifier. The split diaphragm electrostatic speaker disclosed herein provides a simple solution to this problem.

As noted, the diaphragm 11 (FIG. 1) is preferably partitioned into two electrically isolated portions. One portion 11*a* produces high frequency sounds, and the other portion 11*b* (typically larger than the first portion 11*a*) produces low frequency sounds. As shown in the schematic diagrams (FIGS. 26-27 and 29), each diaphragm portion 11*a* and 11*b* of FIG. 1 is preferably fed by a separate step-up transformer (T I and T2 in FIG. 26; 5102 and 5103 in FIG. 29). High-pass and low-pass filters can be used in the audio circuits, so that high frequency signals and low frequency signals are fed to the appropriate portions 11*a* and 11*b* of the diaphragm. For example, in the schematic diagram of FIG. 26, a capacitor C1 and a resistor R10 form an RC high-pass filter ahead of transformer T1, thus only high frequency signals are stepped up by T1 and supplied to the high-frequency portion 11*a* of the diaphragm. Similarly, a resistor R24 and an inductor L6 form a low-pass filter ahead of transformer T2, thus only low frequency signals are stepped up by T2 and supplied to the low-frequency portion 11*b* of the diaphragm. Although not shown, the electrostatic speaker can be divided into more than two sections, each section operating in a different frequency range. In this case, additional filers (high-pass, low-pass and/or band-pass filters) are used to separate an input signal into appropriate bands and fed to appropriate additional transformers.

Each transformer can be optimized for the frequency range in which the transformer operates. Thus, T1 can be optimized for high frequencies, and T2 can be optimized for low frequencies. This simplifies transformer design. In the prior art, a single step-up transformer handles the entire frequency range of the speaker. However, designing a transformer with such a wide operating frequency range is difficult, if not impossible. Transformers according to the disclosed electrostatic speaker system can be smaller and lighter than prior-art transformers. In general, transformers for high frequencies are smaller than transformers for low frequencies.

As shown in the schematic of FIG. 29, the low-pass filter need not include an inductor. The low-frequency diaphragm portion 11*b* exhibits some parasitic capacitance. This capacitance is connected to the secondary winding of transformer 5103, and the transformer reflects the capacitance on the primary side of the transformer. The reflected capacitance and one or more resistors 3109 and 3116 form a low-pass filter. These resistors are in series with the primary, but alternatively may be place in series with the secondary. Using the reflected capacitance for such a low-pass filter provides advantages, in that the RC low-pass filter created by the reflected capacitance exhibits a more favorable roll-off rate, without reducing the impedance the electrostatic speaker presents to an amplifier.

In another embodiment of an electrostatic speaker drive circuit (not shown), a single step-up transformer is used for the entire frequency range. Electrically isolated diaphragm portions (such as 11*a* and 11*b* of FIG. 1) are used for separate frequency ranges. Each diaphragm portion is connected to the secondary winding of the transformer by a separate resistor. The resistance in series with the low-frequency diaphragm portion is larger than the resistance in series with the high-frequency diaphragm portion. These resistances are reflected by the transformer to a circuit connected to the primary winding of the transformer. This circuit includes a capacitor. The capacitor and the reflected resistances form RC filters that provide steeper frequency response curves than the prior art.

Figure 30:
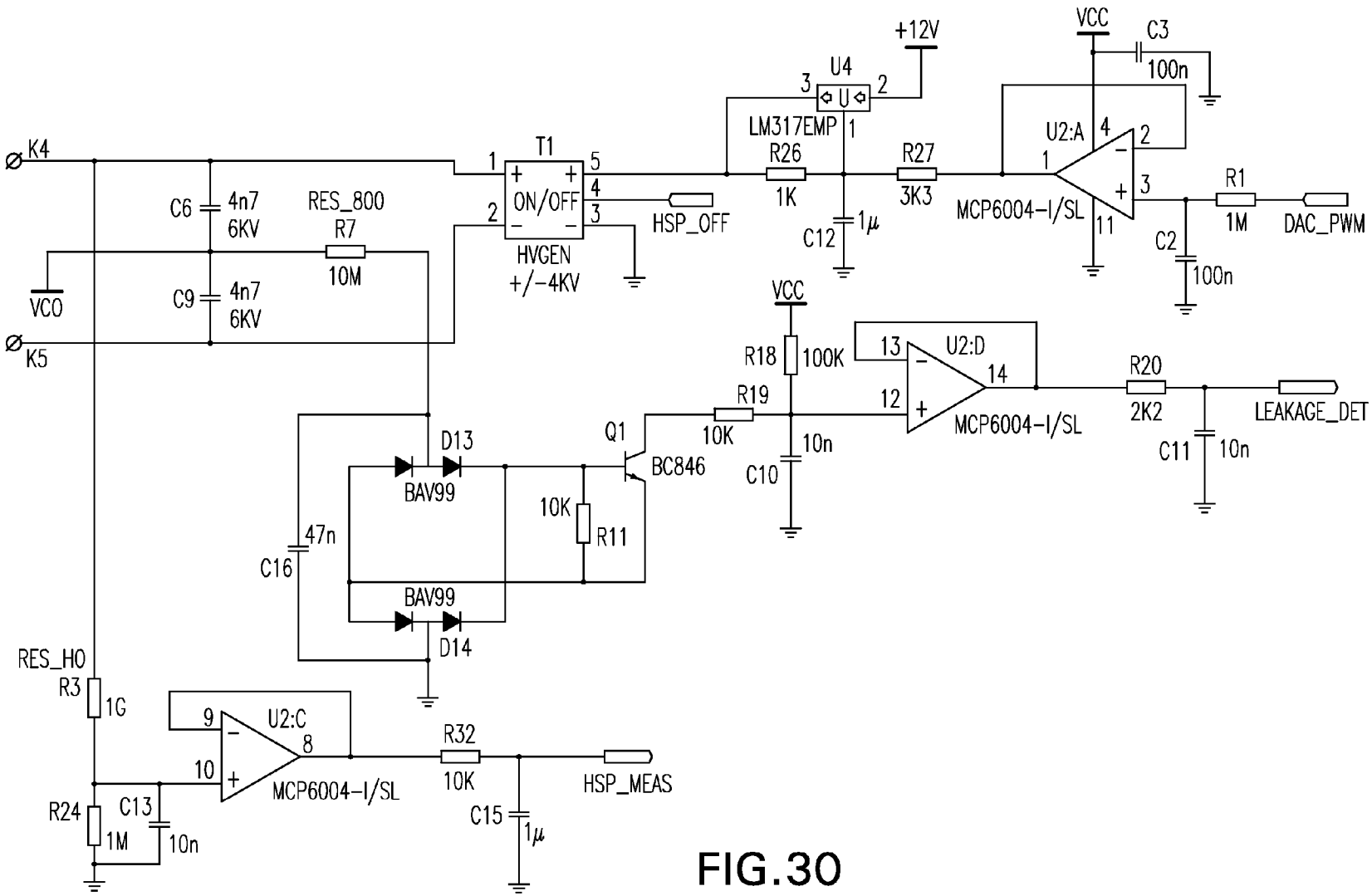
FIGS. 30-34 illustrate a circuit, in accordance with another embodiment of the present invention, in which the safety features described in connection with FIGS. 25-27 and 28-29 are implemented with a microprocessor.
Figure 31:
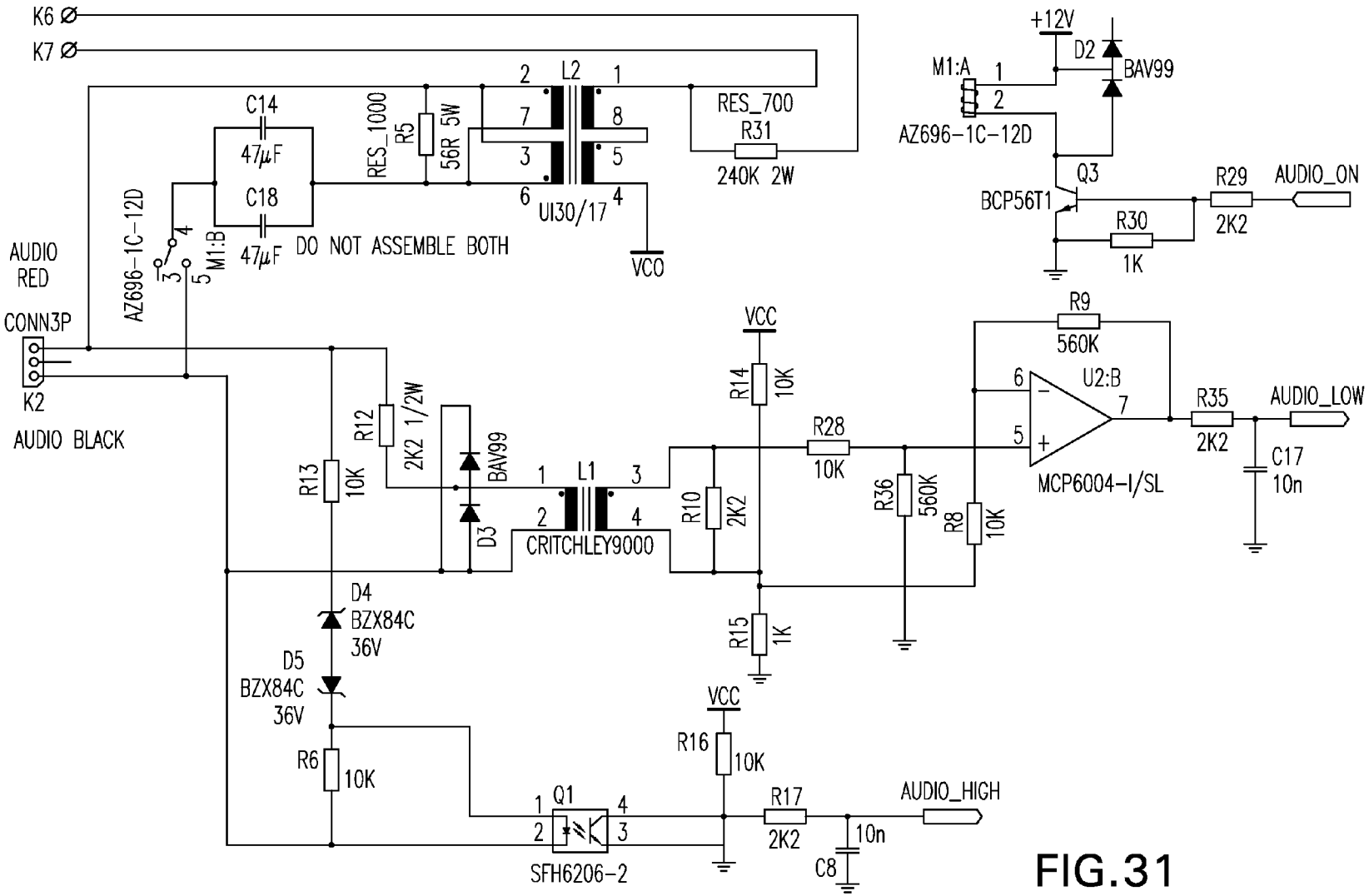

FIGS. 30-34 illustrate a circuit, in accordance with another embodiment of the present invention, in which safety features such as those described in connection with FIGS. 25-27 and 28-29 are implemented with a microprocessor executing instructions that are stored in an associated EEPROM. The stored instructions cause the microprocessor to operate in the manner described here. The approach taken in this embodiment is to provide a a series of circuit groupings, with each grouping associated with a different safety or parameter signal, and to provide an input to the microprocessor in FIG. 33 of each signal. In typical operation, the parameters are measured and controlled approximately 1000 times a second, that is, once per millisecond. Use of a microprocessor enables evaluation of more parameters at a time than can be conveniently accomplished by a normal analog circuit. Our evaluation shows that the microprocessor-based control in typical usage contexts keeps the high voltage on for only some 10 to 20% of time, so that the electrostatic speaker is subject to high voltages and high electric fields for a much shorter time per year. Because the high voltage is on less of the time, use of the microprocessor-based control also reduces somewhat the power consumption of the system. FIG. 30 shows a regulated high voltage power supply, including high voltage generator T1, which operates under control of the microprocessor of FIG. 33. The HSP_OFF signal supplied by the microprocessor of FIG. 33 to pin 4 of the generator T1 is used to gate the high voltage generator T1. In addition, FIG. 31 shows circuitry, associated with resistor R7 (in a fashion analogous to R22 of FIGS. 25 and 3110 in FIG. 28) and diode bridge including dual diodes D13 and D14 (in a fashion analogous to the diode bridges V2 in FIG. 26 and 6110 6111, 6112 and 6113 in FIG. 29) for detecting leakage current caused, for example, by electrical contact of a person with one of the stators shorting of the diaphragm to a stator; the result is a signal in the LEAKAGE_DET line, when leakage is present, delivered to the microprocessor of FIG. 33. In response to a LEAKAGE_DET signal, the microprocessor causes a shutoff of audio and high voltage. The duration of time over which the LEAKAGE_DET signal must be present for causing shut off can be adjusted between 1 and 255 milliseconds.

Figure 33:
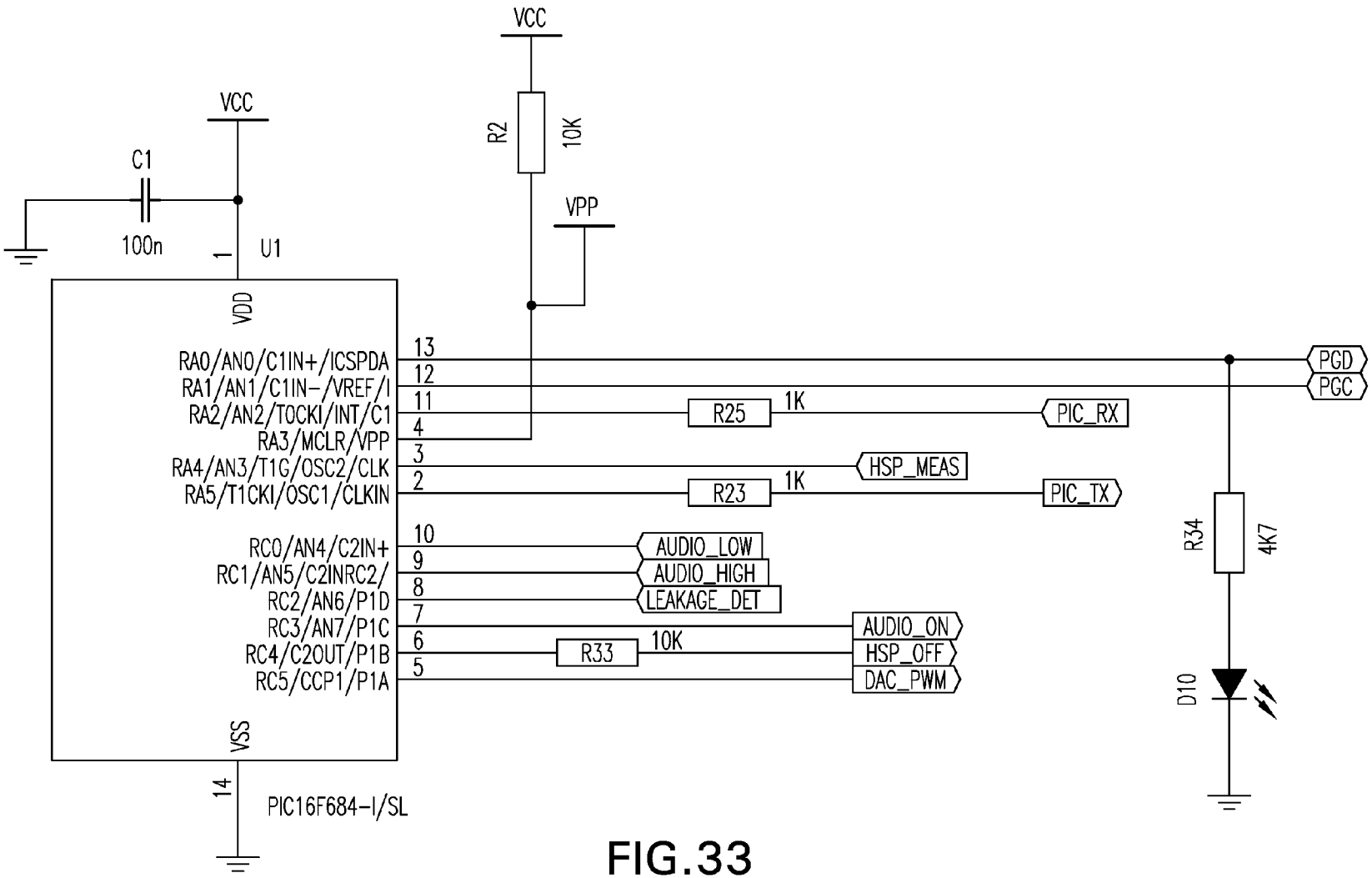

To control (optionally) the voltage from the high voltage generator T1, a signal is also provided on the line DAC_PWM from the microprocessor of FIG. 33. The signal is pulse-width modulated to have a duty cycle proportional to the voltage desired from the high voltage generator. An analog-to-digital converter is emulated by low pass filtering the pulse-width modulated signal with a network including R1 and C2; this signal runs through op amp U2:A, configured as an amplifier, and is used to adjust dc power supplied to pin 5 of the high voltage generator through adjustable regulator LM317EMP, and therefore to adjust the level of high voltage. Finally at the bottom of FIG. 31, a 1000:1 voltage divider established by R3 and R24 feeds through U2:C on line HSP_MEAS a signal indicative of the voltage level of the high voltage supply. The HSP_MEAS signal is fed to the microprocessor of FIG. 33, so that it can (optionally) control intelligently the level of high voltage using signal DAC_PWM. In lieu of this arrangement, one may simply calibrate the voltage applied to pin 5 of high voltage generator T1, for example by adjusting the voltage applied to pin 1 of regulator U4 using suitable trim resistors or a potentiometer, or by other means of regulating the voltage on pin 5 of T1. In FIG. 31 are shown audio step up transformer L2 with audio relay switch, identified as M1:B, in the primary circuit of transformer L2 to switch audio on and off. The switch M1:B is operated by relay M1:A, shown in the upper right portion of FIG. 30, and which is energized by the output of transistor Q3, which is coupled to an audio-on signal AUDIO_ON developed from the microprocessor of FIG. 33.

The circuits at the bottom of FIG. 31 analyze (in a manner described above in connection with FIGS. 25 and 28) the audio signal level at connector K2, and provide an audio-low output signal AUDIO_LOW and an audio-high output signal AUDIO_HIGH; these signals are inputs to the microprocessor of FIG. 33. The audio-low output signal is generated for indicating whether the audio signal is below a specified threshold, and is used to switch off the high voltage. Using the microprocessor of FIG. 33, the audio-low threshold can be adjusted between 1 and 50 mV, and the duration of time over which the audio must be below threshold as a condition for shutting off of the high voltage can also be adjusted between 1 and 255 milliseconds.

The audio-high output is generated when the audio signal is above a specified overload limit, such as 40V, and is used to switch off the audio relay switch M1:A, again the duration of time over which the audio must be above the overload limit as a condition for shutting off of the high voltage and the audio can also be adjusted between 1 and 255 milliseconds.

In each case, described above, where a parameter is used to cause a shutoff when criteria are satisfied, the microprocessor can optionally be programmed not to cause a shutoff.

Figure 32:
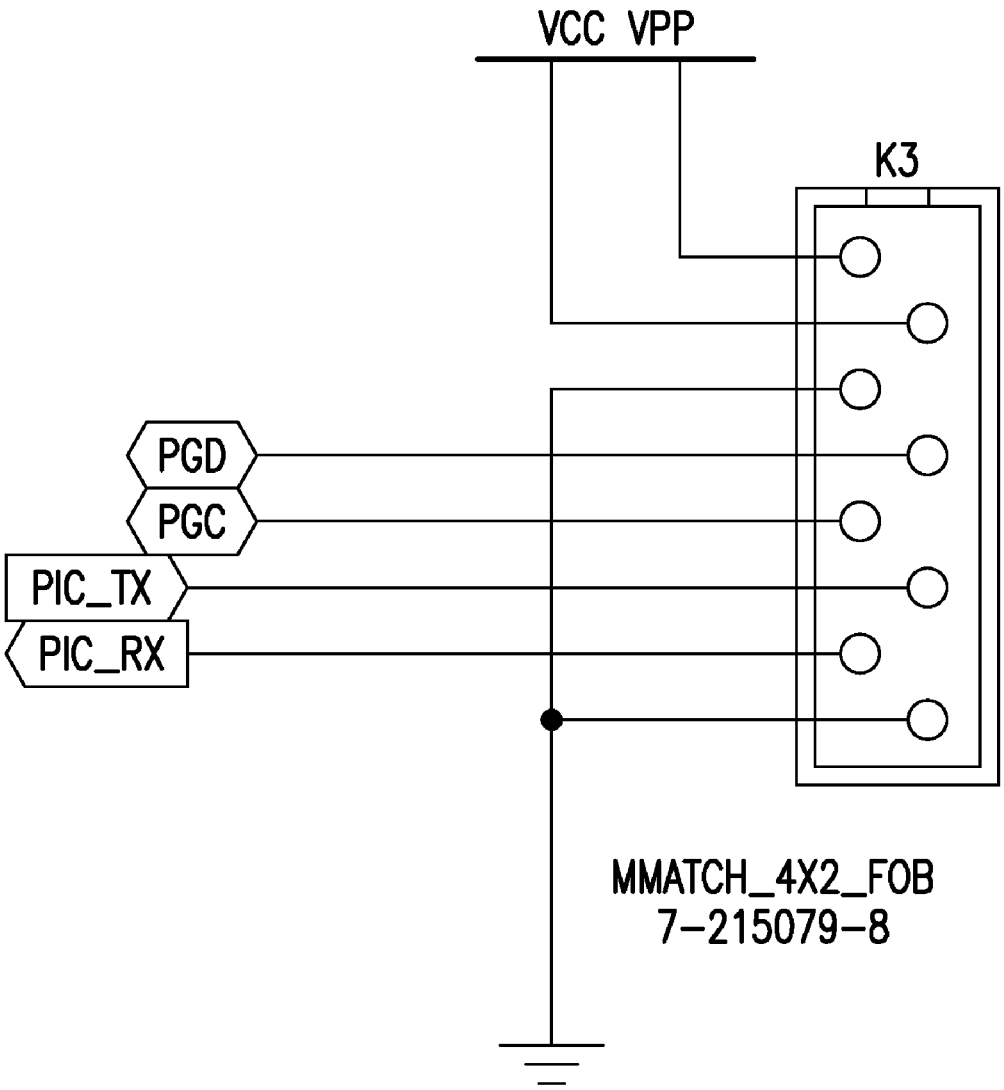

FIG. 32 shows a connector to the system with serial interface and programming interface combined. The connector enables adjustment of several parameters via a laptop or desktop computer, as well as programming or reprogramming the microprocessor itself. The parameters are stored in an EEPROM associated with the microprocessor, so all values are retained even in the event of power loss or normal switch-off of power. The stored parameters, readable through the interface, further include: printed circuit board type, serial number, factory programming date, last reprogramming date, and last parameter update.

FIG. 33 shows the microprocessor itself, item U1, along with a series of signal inputs, including HSP_MEAS, AUDIO_LOW, AUDIO_HIGH, and LEAKAGE_DET, along with a series of outputs including AUDIO_ON, HSP_OFF, and DAC_PWM. Optionally, the microprocessor can be used to gather statistics pertinent to operation of the system, such as an hour counter to determine how long the high voltage is switched on, as well as other counters for the number of overloads, and how many high voltage leakage faults have been detected.

Figure 34:
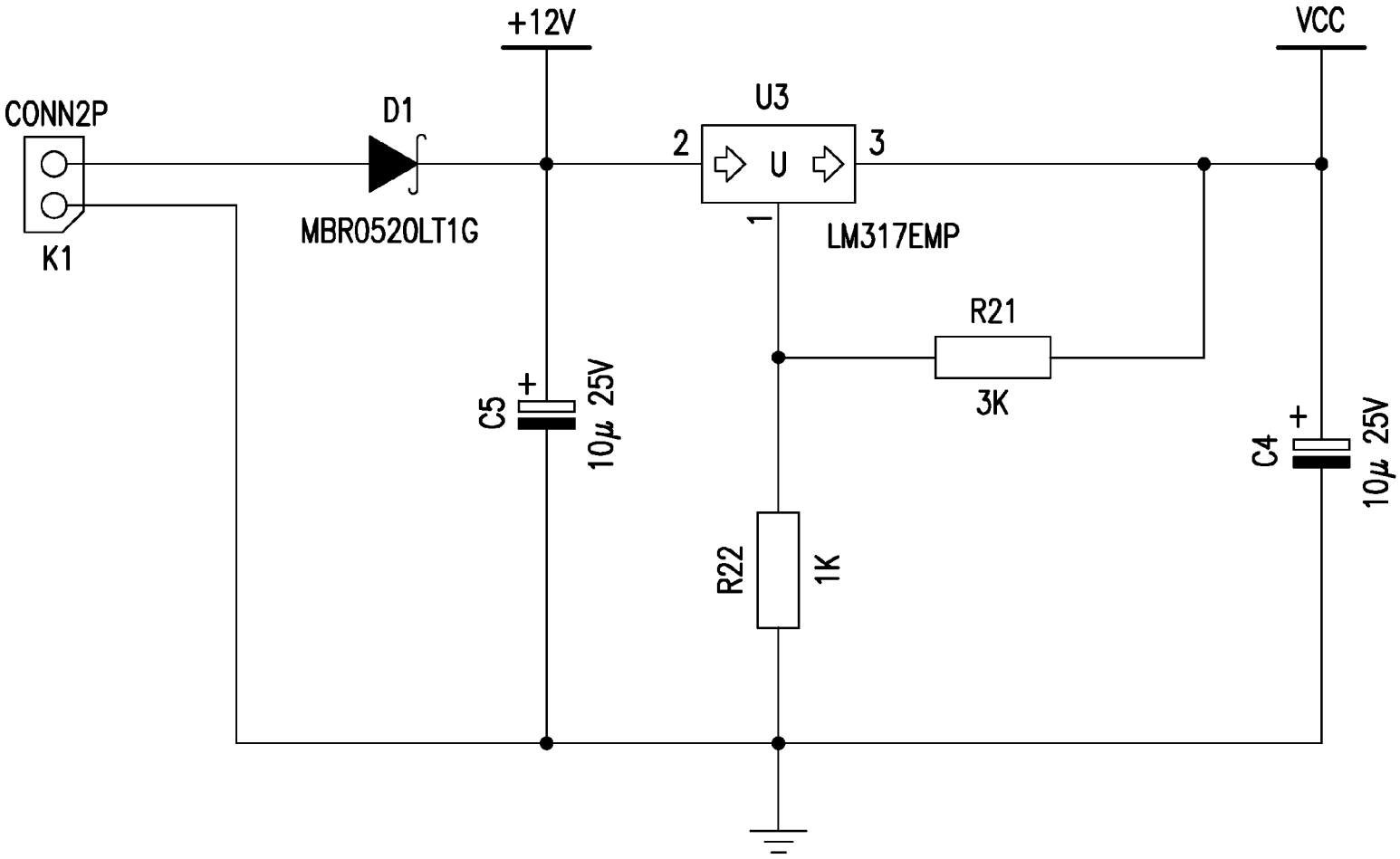

FIG. 34 shows a DC power circuit for the unit, which obtains raw DC from input jack K1, and 12 volts DC via Schottky rectifier D1. Voltage regulator U3 provides a regulated output VCC that is used by the system, including the microprocessor of FIG. 33.

Stacking to Produce Multi-layer Speaker Systems

Figure 35:
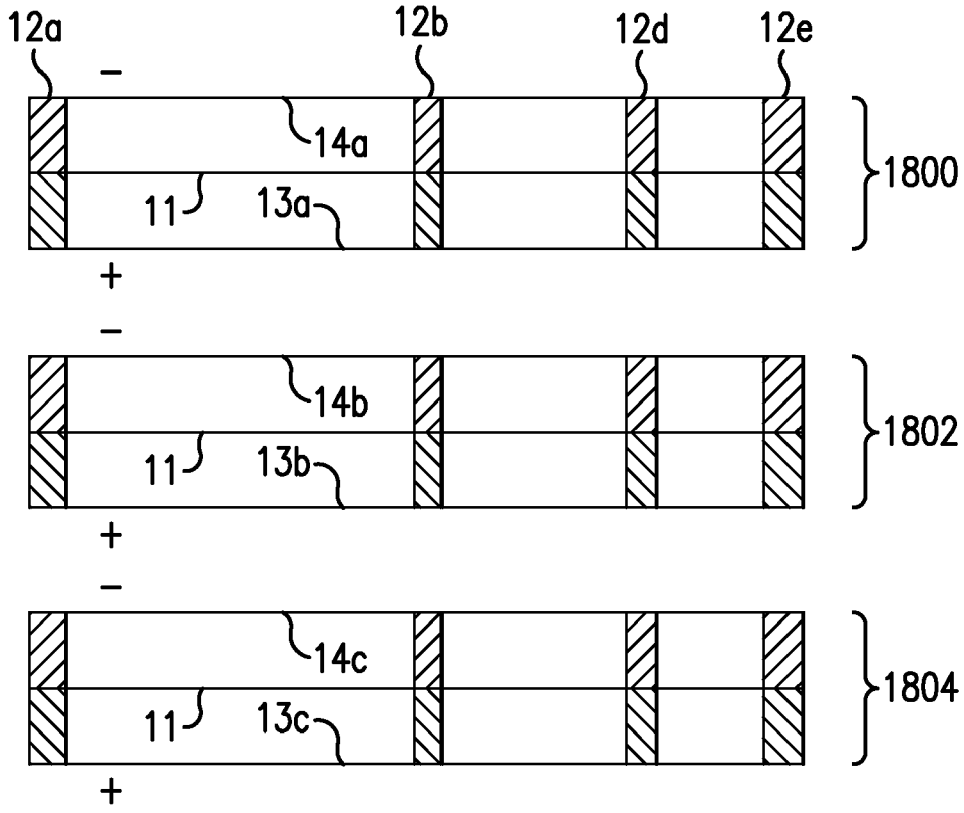
FIGS. 35-37 show cross sections of stacks of two or more electrostatic speaker elements (panels) in accordance with a further embodiment of the present invention.
Figure 36:
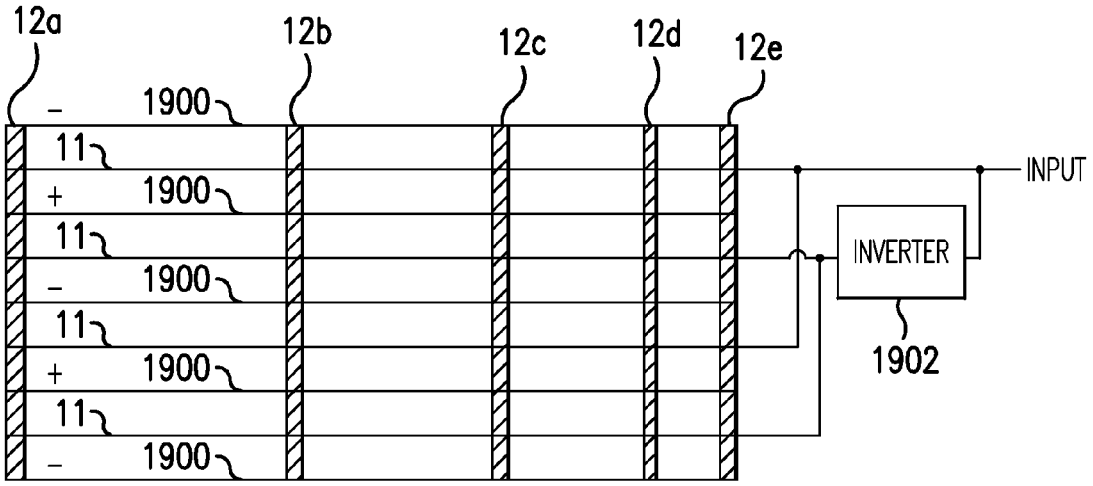
Figure 37:
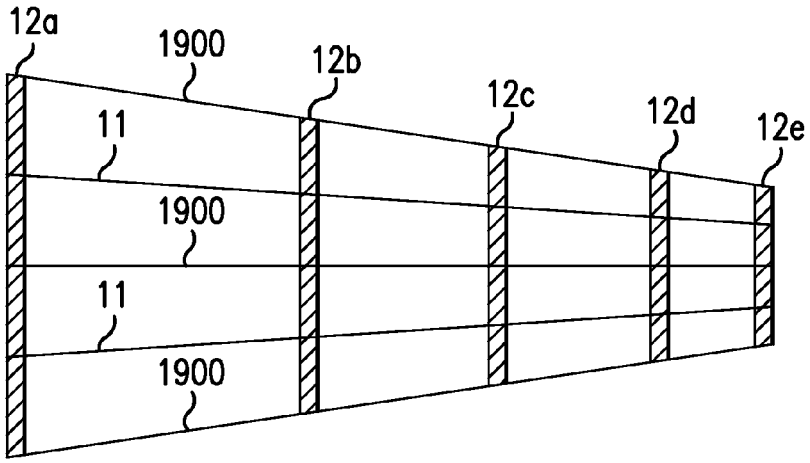

FIGS. 35-37 show cross sections of stacks of two or more electrostatic speaker elements (panels) in accordance with a further embodiment of the present invention. Such a stack can be used when increased sensitivity or, alternatively, decreased diaphragm-to-stator spacing is desired. In the embodiment shown in FIG. 35, three electrostatic speaker elements 1800, 1802 and 1804 are stacked; however, other numbers of elements can be stacked. In this embodiment, adjacent stators of adjacent elements (such as stators 13*a* and 14*b*) are oppositely charged, as indicated by plus (+) and minus (−) signs. All the diaphragms 11 are electrically connected together or driven with in-phase signals. In one such embodiment, the adjacent stators of adjacent elements (such as stators 13*a* and 14*b*) are both constructed on a common substrate. For example, a double-sided printed circuit board can be a substrate for the two stators 13*a* and 14*b*.

FIG. 36 shows another stacked electrostatic speaker. In this embodiment, only one stator 1900 is disposed between each adjacent pair of diaphragms 11. Adjacent stators 1900 are oppositely charged, as indicated by the plus (+) and minus (−) signs. Alternate diaphragms 11 are connected together, and the two sets of diaphragms are driven by oppositely phased (i.e., inverted) signals. For example, an inverter 1902 can be used to generate one of the oppositely-phased signals. Alternatively, symmetric transformers can be used to generate the oppositely-phased signals. Although four diaphragms 11 are shown, other numbers of diaphragms and stators 1900 can be used.

Stacked electrostatic speakers can also include non-parallel stators, stepped stators and/or stators of varying thickness, as discussed above with reference to FIGS. 21-24. For example, as shown in FIG. 37, non-parallel stators 1900 are used in a stacked electrostatic speaker.

As noted, an electrostatic speaker can have two or more sections, each section reproducing a different (and possibly overlapping) range of frequencies. One or more of these sections can each be fed by a circuit that includes a high-pass, low-pass, band-pass or other type of filter, as discussed in more detail below. However, all the filters in all these circuits may not have identical delay characteristics. Thus, signals provided to one or more of the sections of the speaker may arrive at the sections later than signals provided to one or more other sections of the speaker.

For example, in a two-section electrostatic speaker, the circuit that feeds the low-frequency section (for example, section 1700 (FIG. 23) may include a low-pass filter, whereas the circuit that feeds the high-frequency section (for example, section 1708) may not include a filter or may include a high-pass filter. In either case, the low-pass filter may delay signals by about 0.25 mSec. more than the high-pass filter or no filter at all delays other signals. Consequently, the low-frequency signals may arrive at the low-frequency section 1700 later than the high-frequency signals arrive at the high-frequency section 1708. This difference in signal arrival times at the respective sections causes a corresponding difference in arrival times of acoustic signals (sound) at a listener. In this example, low frequency sounds arrive at the listener about 0.25 mSec. before corresponding high frequency sounds, reducing the fidelity perceived by the listener.

Electronic Compensation

Figure 38:
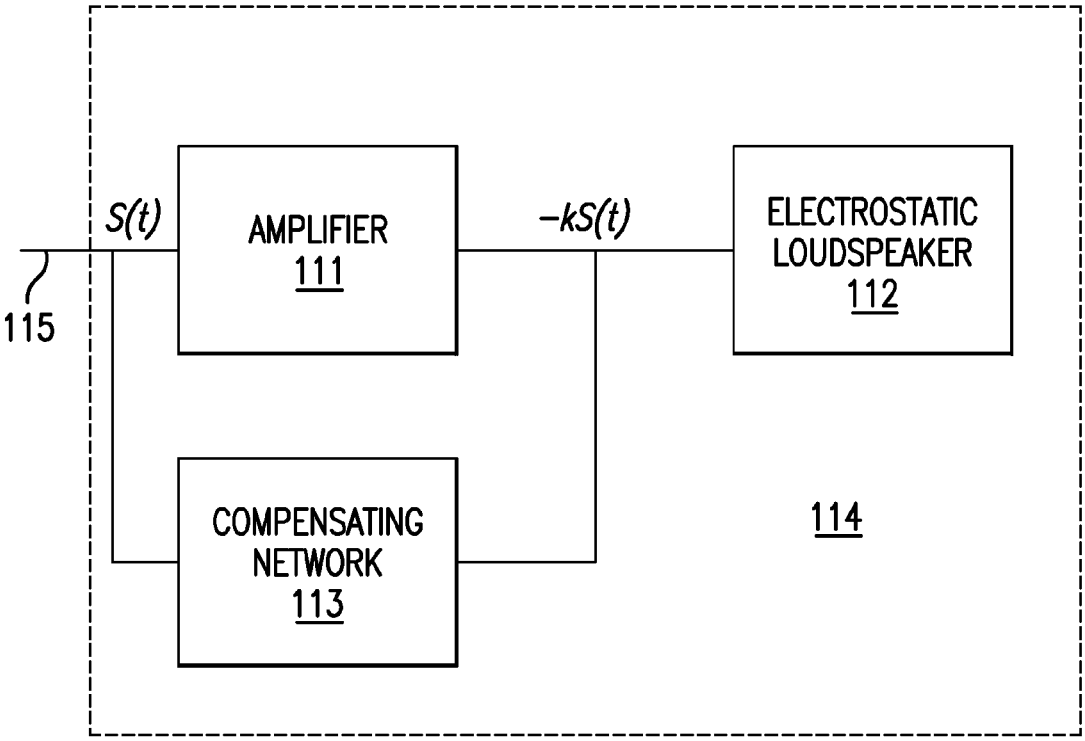
FIGS. 38-40 illustrate electronic compensation arrangements in accordance with further embodiments of the present invention.

In another embodiment of the present invention, illustrated in FIG. 38, may be implemented to advantage of an integrated assembly of electronics with the electrostatic loudspeaker in a fashion analogous to that illustrated in FIGS. 9 and 10. In the present embodiment is provided an entire amplifier 111 coupled to the electrostatic loudspeaker 112. In addition there is included a negative feedback path over which a portion of amplified signal −kS(t), out of phase with input signal S(t), is fed back to the input after running through a compensating network 113. Optionally the electronics of this system may be included in the integrated assembly mounted in a housing as part of an assembly also including a driver for the electrostatic speaker. The compensating network, which may be active or passive as desired, is designed to compensate for irregularities in the response of the electrostatic loudspeaker 112. (Of course, it may also compensate for irregularities in the amplifier 111 itself, in a manner known in the art.) Because the electrostatic loudspeaker 112 does not exist in isolation but is invariably deployed in a room itself having characteristics that affect the color and quality of sound from the loudspeaker 112, the compensating network may be configured to compensate for adverse effects of the room (either based on generalized room parameters and typical loudspeaker placement in it) or tailored to a specific room and actual loudspeaker placement.

One method of determining the configuration of the compensating network 113 empirically is to employ a suitable source, such as a sweep generator, coupled to the input 115 and to evaluate the output of a reference microphone, placed in the room where a listener would normally listen to the loudspeaker. The compensation network can then be configured to flatten the overall system frequency response, to reduce harmonic and intermodulation distortion, to make phase delay more uniform over the audible spectrum, and generally to reduce artifacts of reproduction. (Note that a compensation network configured to produce a flat response of the amplifier 111 is likely not configured to produce a flat response of the entire system including the loudspeaker in a room setting, since the loudspeaker in the room setting will not have a flat response.) This approach may be taken a step further by considering that the loudspeaker is not likely to be used alone, but rather at least in a paired configuration or multiple loudspeaker configuration. Accordingly each of the multiple loudspeakers may be implemented as herein described, and the compensating network 113 for each may be configured so that collectively the system of loudspeakers provides a desired response characteristic.

Although we have discussed using a microphone to design the configuration of the compensating network 113, it is also possible to couple the input of the compensating network 113 to an appropriately positioned microphone instead of directly to the output of amplifier 111, so as to make the output of the loudspeaker 112 an active part of the feedback path. In this manner, the system can be adapted to room acoustics. Even if the microphone is not an active part of the feedback path in operation of the system, it still can be provided as a part of the loudspeaker system and used in a set-up operation to configure the compensating network 113. As an example, a microphone built into the loudspeaker system can be used to measure the response of the loudspeaker or a physical parameter that relates to the loudspeaker response curve. Alternatively or in addition, a microphone can be used on the rear side of the loudspeaker to reduce adverse phase-cancellation effects from sound reflected from a wall that faces the rear side of the loudspeaker.

A related embodiment specifically addresses phase cancellation effects. The electrostatic loudspeaker may be understood as a dipole line array. When the array is mounted near a wall, the frequency response of a wall mounted dipole panel is adversely affected by reflections from the wall to which it is mounted. The stiffness of the wall and the angular alignment of the panel to the wall (parallel being worst) affect the amplitude of the interfering reflection. The interfering reflection is continuous and is delayed by an amount proportional to the distance the panel is mounted from the reflecting wall.

Because these reflections are full bandwidth and are delayed by a constant (and short) amount of time, the result is the formation of a comb filter whose characteristics are fairly predictable because the distance from the wall is known exactly, the angular alignment can be known exactly, and the composition of the wall may be estimated fairly accurately, or in the case of a factory assembled cabinet (acting as a wall), also known exactly.

Accordingly, an embodiment of the present invention employs an inexpensive digital signal processing approach first to derive a correaction signal by delaying the input signal to the loudspeaker by an amount exactly equal to the wall reflection's travel time and inverting the delayed signal, and then second to electrically sum this correaction signal with the driving signal in order to cancel deleterious effects of the wall reflection by reducing the amplitude of the comb filter created by the wall reflection. Initial lab experiments tend to support this conclusion.

The foregoing embodiment may be understood by recourse to the following model. Consider a signal x(t) that is subject to a delay of delta t to produce a composite signal y(t). Taking the Laplace transform of both sides of this equation, we model this signal in the s-plane and determine a transfer function H(s) that characterizes the effect in the s-plane. We therefore derive the transfer function as follows:

$$y(t) = x(t) + x(t - \Delta t)$$

$$Y(s) = X(s) + e^{j\omega\Delta t}X(s)$$

$$H(s) = 1 + e^{j\omega\Delta t}$$

$$H(s) = e^{j\omega\frac{\Delta t}{2}}\left(e^{-j\omega\frac{\Delta t}{2}} + e^{j\omega\frac{\Delta t}{2}}\right)$$

$$|H(s)| = \left|2\cos\left(\frac{\omega\Delta t}{2}\right)\right|$$

Figure 39:
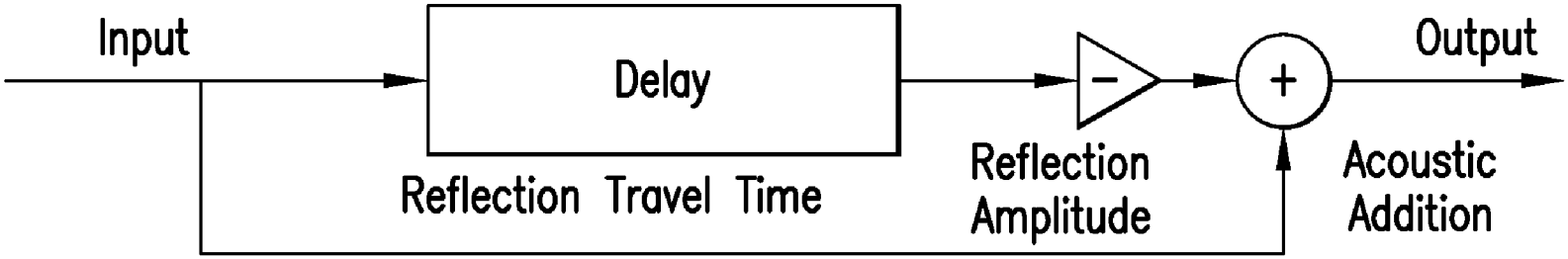

Next, we model the acoustic delay and reflection from the rear wall added to the panel's signal as shown in FIG. 39. Note the minus sign after the delay, as this models what is "seen" from the front of the panel.

Figure 40:
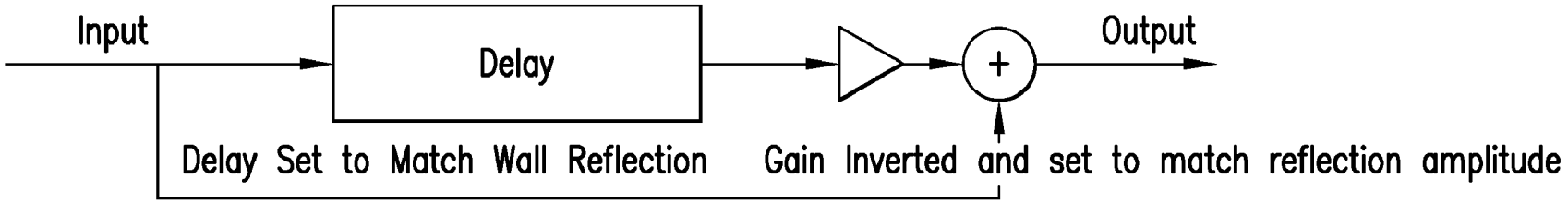

To cancel the effects of the acoustic delay and reflection, we therefore develop a correaction signal in accordance with the diagram of FIG. 40.

In yet another embodiment, there is created an analog comb filter, similar to a filter used to simulate "flanging" in the musical instrument industry in the years before inexpensive audio delay lines were available. "Flanging", which was invented by John Lennon (Beatles), originated in the recording studio, and was originally created by placing a manual drag (a finger) on the edge of the feed reel (the flange) of one of two synchronized 4 track tape recorders during playback. Carefully varying the drag produced a swept comb filter, one that varies in frequency, which imparted the unique "whooshing" sound effect heard on "I am the Walrus." The musical instrument (MI) industry came up with an electronic circuit, simulating the effect, which came into wide use around 1970 or so. The electronic circuit used a number of voltage controlled filters, arranged so that they would track together under the influence of a slowly varying AC voltage waveform. The very first of these, made by Carl Countryman Associates, was not automated, and requited that the user turn a manual control to sweep the comb filter. Since the distance from the wall to the panel does not vary, there is no need to sweep the comb filter in this application, but the compensating circuit may be fine tuned by manually sweeping a comb filter such as developed by Countryman.

The use of long or high loudspeakers (such as described above) emphasizes the line-dipole character of these loudspeakers. When the line-dipole character is emphasized, the sound generated by the loudspeaker is less dependent on room geometry and conditions than in the case of traditional point-source radiators. Consequently loudspeakers, such as described above, emphasizing line-dipole characteristics, provide a greater freedom in the choice of the location of the loudspeakers, both in a classic stereo environment and in the increasingly popular home theatre configurations with 5 loudspeakers.

Class D Embodiments Uniquely Adapted to Electrostatic Loudspeakers

In an embodiment related to that described above in connection with FIG. 38, the amplifier 111 is a class-D amplifier. A class-D amplifier is one in which the output transistors are operated as switches. Background information on class-D amplifiers can be found in "The Class-D Amplifier" in W. Marshall Leach, Jr., *Introduction to Electroacoustics and Audio Amplifier Design* (Revised Printing 2001), available at http://www.ee.ucr.edu/~rlake/EE135/Class_D_amp_notes_AL.pdf; and in "Class D Audio Amplifier Design" by International Rectifier, available at http://www.irf.com/product-info/audio/classdtutorial.pdf. These documents, which form a part of the Provisional Application described at the beginning of this section, are hereby incorporated herein by reference. The International Rectifier document includes a "Class D Amp Reference Design," which is exemplary of the type of amplifier suitable for the present context (including use of a feedback path and compact size), although the MOSFET output transistors must be selected to be compatible with the high voltage environment necessary for driving an electrostatic speaker. In this embodiment, the compensating network 113 of FIG. 38 can be used both for the negative feedback path for the amplifier 111 and for the electrostatic speaker, as previously discussed.

In another embodiment of the present invention, as an alternative to using MOSFET output transistors that are compatible with the high voltage environment of an electrostatic speaker, one may employ less expensive output transistors capable, for example, of switching at an intermediate voltage of about 1000 VDC. Then one may recover and filter the audio signal at that voltage level, and then employ a post-filter audio bandwidth step-up transformer having a 1:5 step-up ratio. A disadvantage of this approach is the difficulty of making a cost-effective transformer that is well behaved across the entire audio spectrum in both voltage and phase response.

In a further embodiment of the present invention, there is employed a pulse transformer placed before audio recovery to achieve the needed voltage step-up. Since the pulse transformer needs to operate over a very limited bandwidth, it is cheaper, lighter, and much easier to design than a full-bandwidth audio transformer, and the increased cost of the components needed to recover and filter the audio signal at 5000V (as opposed to 1000V in the previous embodiment) is offset by the fact that the electrostatic element being driven is highly capacitive in and of itself.

Figure 41:
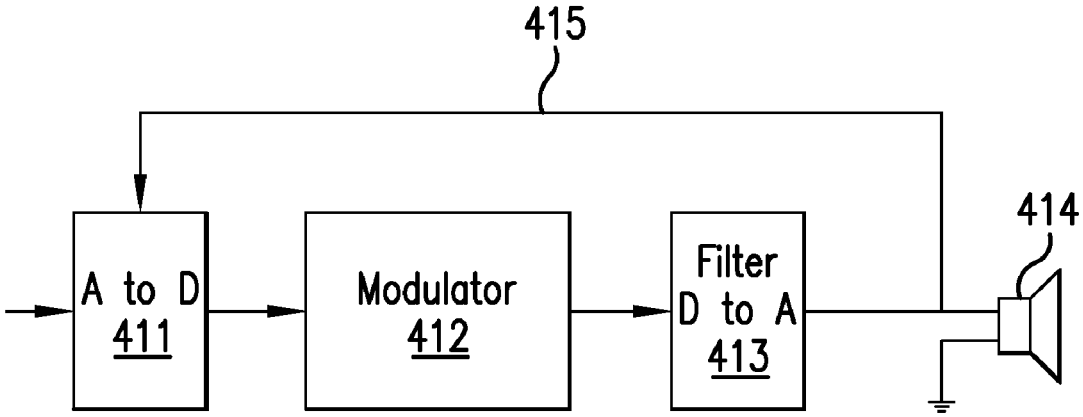
FIG.41 (PRIOR ART)
FIG. 41 illustrates a prior art Class D amplifier.

In general, the Class D amplifier design of the prior art, exemplfied in FIG. 41, includes an analog-to-digital converter 411 (which receives the audio input), coupled to provide a digital output to modulator 412. The modulator's output is coupled to a filter 413, which serves as a digital-to-analog converter, and the filter's output is fed to loudspeaker 414. A negative feedback path over line 415 from the output of the filter 413 to the analog-to-digital converter 411 helps improve performance of the amplifier.

Figure 42:
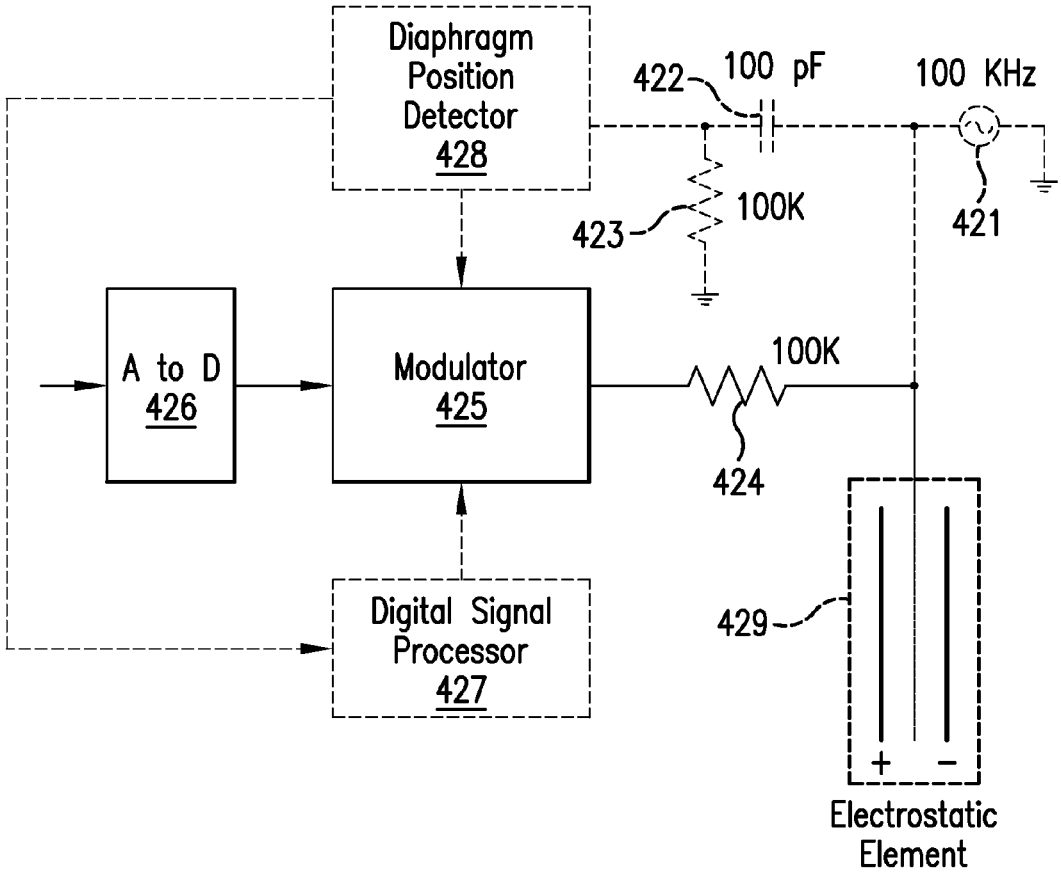
FIG. 42 illustrates a Class D amplifier integrated with an electrostatic speaker element in accordance with an embodiment of the present invention.

In FIG. 42 is shown another embodiment of the present invention, in which some or all of the components of the filter 413 are eliminated and there is utilized the parasitic capacitance of the electrostatic speaker itself to achieve filtration. Here the modulator's output is fed through resistor 424 (which may, for example, be in the vicinity of about 100K ohms or another suitable value) to the diaphragm of an electrostatic speaker element 429 (which is invertedly driven as described above, for example, in connection with FIGS. 25-27). The impedance of the parasitic capacitance of the electrostatic speaker element is low at typical frequencies used for the triangle (or other suitable) waveform provided in modulator 425, and so the voltage of the waveform across the electrostatic speaker element is made small as a result of the voltage divider circuit formed with resistor 424.

Also in FIG. 42, there is shown an optional method for supplying diaphragm position information as negative feedback to modulator 425. Feeding back electrostatic speaker diaphragm position information is itself unusual, but more unusual is providing this feedback in the digital domain as opposed to the analog domain as in FIG. 41.

Because the parasitic capacitance of the loudspeaker varies slightly with diaphragm position, the parasitic capacitance can be used to sense position of the diaphragm. Here we show use of an oscillator 421 operating at a frequency above the audible range, for example, 100 kHz, to generate a signal that is modulated by change in internal capacitance of the electrostatic speaker element. (The modulation may conveniently be frequency modulation or amplitude modulation.) The resulting signal goes through a high-pass filter formed by capacitor 422 (which may, for example, be 100 pF) and resistor 423 (which may, for example, be 100 k ohms), and is fed to a diaphragm position detector 428, which demodulates the oscillator's signal and derives diaphragm position information from the demodulated signal. The diaphragm position information is used in the modulator 425 for suitable negative feedback. As we noted near the beginning of this description, it is within the scope of the present invention to provide a second conductive layer on the diaphragm that can be used exclusively for position sensing, and, in such an embodiment, such a conductive layer could be used in the manner described herein, with the exception that resistor 424 from the modulator 425 would be connected to a layer of the diaphragm that is different from the layer to which is connected the oscillator 421 and capacitor 422.

Although we have described use of the oscillator 421, in another embodiment of the present invention, the oscillator is eliminated, and instead there is employed the triangle wave signal used in the modulator 425. Although low pass filtering makes the level of such signal low relative to the audio signal on the speaker diaphragm, under some circumstances, such a signal may be utilized to obtain speaker position information.

Optionally, digital signal processor 427 of FIG. 42 is used to create any desired performance of the system including the electronics and the electrostatic speaker element. If the digital signal processor 427 is employed, the diaphragm position detector 428 is coupled to it to provide it with diaphragm position information. In fact, in a further embodiment, there may be utilized an electrostatic speaker system, such as that of FIG. 1, employing a plurality of speaker elements to cover differing frequency ranges, and there may be provided a separate Class D amplifier for each speaker element. In such embodiment, the cross over design may be implemented in the digital signal processor 427 for each speaker element; in other words, a high frequency speaker element may be restricted to high frequency audio by operation of the digital signal processor for that element, whereas the speaker element for mid and low frequencies may be restricted from high frequency audio by operation of its corresponding digital signal processor. Moreover, the digital signal processor may be configured, in the manner described above in connection with FIG. 38, to reduce artifacts of sound reproduction by the speaker, such artifacts including phase cancellation effects caused by wall reflection of sound emanated from the rear of the speaker.

Head Related Transfer Function Embodiments

In another embodiment of the present invention, there is provided a Head Related Transfer Function (HTRF) in conjunction with a pair of electrostatic loudspeakers to provide virtual surround sound of superior quality. For further information on HTRF, the following documents are incorporated herein by reference: Bill Gardner and Keith Martin, "HRTF Measurements of a KEMAR Dummy-Head Microphone," available at http://sound.media.mit.edu/KEMAR.html; Sarah Coppin, Kim Daniel, Jeremy Pearce, Chris Rozell, and Yasushi Yamazaki, "Sound Localization Using Head Related Transfer Functions," available at http://www.ece.rice.edu/~crozell/courseproj/431report/.

HRTF algorithms depend in large part on being accurately reproduced at the listener's ears. It is axiomatic that headphones are the best sort of transducer to use, because their use completely eliminates the unpredictable and destructively "masking" interference of listening room response.

Although the effects of room response cannot be eliminated altogether, they can be mitigated through the use of a dipole array approximated by an electrostatic loudspeaker in accordance with embodiments herein as opposed to the usual frequency variable monopole (box speaker). Dipole loudspeakers are very effective in suppressing near-wall reflections, and therefore reduce room interaction and increase the direct sound to reflected sound by around 4.8 dB. (The derivation of that figure and supporting logic are based on material from Sigmund Linkwitz's web site, http://www.linkwitzlab.com; such material is reproduced in the Provisional Application.)

What is claimed is:

1. An electrostatic speaker system comprising:

a plurality of electrostatic speaker elements, each electrostatic speaker element including:

first and second stators and a diaphragm disposed therebetween, each of the stators and the diaphragm having an electrically conductive portion, wherein:

the conductive portions of the first stators are electrically coupled to each other;

the conductive portions of the second stators are electrically coupled to each other; and the conductive portions of the diaphragms are electrically isolated from each other.

2. A speaker system according to claim 1, wherein the conductive portion of the diaphragm of a first one of the speaker elements has a surface area that is substantially greater than the surface area of the conductive portion of the diaphragm of a second one of the speaker elements, so that the first and second speaker elements are each suited to handling distinct first and second frequency ranges respectively, the first frequency range being lower than the second frequency range.

3. A speaker system according to claim 2, wherein spacing between the first and second stators of the first one of the speaker elements is greater than spacing between the first and second stators of the second one of the speaker elements.

4. A speaker system according to claim 2, wherein all the first stators of the speaker elements are regions of a common first stator for all speaker elements, all the second stators of the speaker elements are regions of a common second stator for all speaker elements, and the conductive portions of the diaphragms are regions of a common diaphragm for all speaker elements.

5. A speaker system according to claim 4, wherein a pair of conductive portions of the common diaphragm share a non-conductive boundary and wherein at least one spacer is disposed between the common first stator and the common diaphragm and between the common second stator and the common diaphragm, while no spacer coincides with the non-conductive boundary.

6. A speaker system according to claim 4, wherein the common first stator and the common second stator are mounted obliquely with respect to one another, so as to achieve differentially greater spacing between stators of the first one of the speaker elements than between stators of the second one of the speaker elements.

7. An electrostatic speaker system according to claim 1, further comprising:

a dc high voltage source having a positive potential, relative to a reference node, electrically coupled to the conductive portions of the first stators and a negative potential, relative to the reference node electrically coupled to the conductive portions of the second stators; and a separate audio signal path associated with each diaphragm, each separate audio signal path being electrically coupled to the conductive portion of the associated diaphragm and relative to the reference node.

8. The electrostatic speaker system of claim 7, wherein each separate audio signal path includes a separate step-up transformer.

9. The electrostatic speaker system of claim 8, wherein each step-up transformer has a characteristic selected for a different frequency range.

10. The electrostatic speaker system of claim 8, further comprising a resistor in series with a winding of at least one of the step-up transformers, so that a parasitic capacitance of the electrically conductive portion of the diaphragm associated with the step-up transformer in relation to the corresponding stators, as reflected by the step-up transformer, cooperates with the resistor to form a low-pass filter.

11. The electrostatic speaker system of claim 8, further comprising a resistor in parallel with a winding of at least one of the step-up transformers, so that a parasitic capacitance of the electrically conductive portion of the diaphragm associated with the step-up transformer, in relation to the corresponding stators, as reflected by the step-up transformer, is reduced so as to provide reduced high frequency attenuation.

12. The electrostatic speaker system of claim 7, wherein one of the separate audio signal paths includes a low-pass filter and the other of the audio signal paths includes a high-pass filter.

* * * * *